US009047814B2

(12) United States Patent
Toyomura et al.

(10) Patent No.: US 9,047,814 B2
(45) Date of Patent: Jun. 2, 2015

(54) PIXEL CIRCUIT, DISPLAY DEVICE, ELECTRONIC APPARATUS, AND METHOD OF DRIVING PIXEL CIRCUIT

(75) Inventors: Naobumi Toyomura, Kanagawa (JP); Katsuhide Uchino, Kanagawa (JP)

(73) Assignee: SONY CORPORATION (JP)

( * ) Notice: Subject to any disclaimer, the term of this patent is extended or adjusted under 35 U.S.C. 154(b) by 211 days.

(21) Appl. No.: 13/534,494

(22) Filed: Jun. 27, 2012

(65) Prior Publication Data

US 2013/0009933 A1 Jan. 10, 2013

(30) Foreign Application Priority Data

Jul. 7, 2011 (JP) ..... 2011-150938

(51) Int. Cl.
*G09G 3/32* (2006.01)

(52) U.S. Cl.
CPC ..... *G09G 3/3225* (2013.01); *G09G 2300/0408* (2013.01); *G09G 2300/0819* (2013.01); *G09G 2300/0861* (2013.01); *G09G 2310/0251* (2013.01); *G09G 2310/0262* (2013.01)

(58) Field of Classification Search
CPC ..... G09G 3/3225; G09G 2300/0408; G09G 2300/0819; G09G 2300/0861; G09G 2310/0251; G09G 2310/0262
See application file for complete search history.

(56) References Cited

U.S. PATENT DOCUMENTS

| | | | | |
|---|---|---|---|---|
| 2002/0050962 | A1* | 5/2002 | Kasai | 345/76 |
| 2006/0054894 | A1* | 3/2006 | Miyake et al. | 257/72 |
| 2007/0164962 | A1* | 7/2007 | Uchino et al. | 345/92 |
| 2008/0231200 | A1* | 9/2008 | Yamamoto et al. | 315/169.3 |
| 2008/0291351 | A1* | 11/2008 | Han et al. | 349/48 |
| 2010/0182352 | A1* | 7/2010 | Nakamura et al. | 345/691 |

FOREIGN PATENT DOCUMENTS

| | | |
|---|---|---|
| JP | 4240059 | 1/2009 |
| JP | 4240068 | 1/2009 |

* cited by examiner

*Primary Examiner* — Claire X Pappas
*Assistant Examiner* — Richard Hong
(74) *Attorney, Agent, or Firm* — Sheridan Ross P.C.

(57) ABSTRACT

A pixel circuit including: an electrooptic element; a hold capacitor; a write transistor writing a drive voltage corresponding to a video signal supplied to one of main electrode terminals thereof to the hold capacitor; and a drive transistor driving the electrooptic element in accordance with the drive voltage written to the hold capacitor. A pixel circuit is adapted such that it can suppress turn ON of the electrooptic element during a first processing in which a current is supplied to the hold capacitor through the drive transistor while the drive voltage corresponding to the video signal is written to the hold capacitor through the write transistor.

15 Claims, 14 Drawing Sheets

PIXEL CIRCUIT, DISPLAY DEVICE, ELECTRONIC APPARATUS, AND METHOD OF DRIVING PIXEL CIRCUIT

BACKGROUND

The present disclosure relates to a pixel circuit, a display device including the pixel circuit, an electronic apparatus including the display device, and a method of driving the pixel circuit (display device).

At present, a display device including a pixel circuit (referred to as "a pixel" as well) having a display element (referred to as "an electrooptic element" as well), and an electronic apparatus including the display device are generally utilized. There is known a display device which uses an electrooptic element in which luminance changes depending on a voltage or a current applied thereto as a display element in a pixel. For example, electrooptic elements that change luminance depending on the voltage applied thereto is typified by the liquid crystal display element. On the other hand, electrooptic elements that change luminance depending on the current applied thereto is typified by the organic electroluminescence element (organic EL element or organic light emitting diode (OLED); hereinafter referred to as "an organic EL element"). An organic EL display device using the latter, the organic EL element, is a so-called self-emission type display device which uses the self-emission electrooptic elements as the display element in pixels.

Incidentally, in the display device using the display element, the system for driving the display device may be either of the passive matrix system and the active matrix system. However, a display device adopting the passive matrix system involves a problem that it may be difficult to realize a large-size and high-definition display device although the structure is simple.

For this reason, in recent years, active development has been carried out on the active matrix system which controls pixel signals supplied to a display element in a pixel by using an active element in the pixel, for example, an transistor such as an insulated gate field-effect transistor (in general, Thin Film Transistor (TFT)) as a switching transistor.

In the existing display devices utilizing the active matrix system, the threshold voltages and mobilities of the transistors for driving display elements may vary due to process variation. In addition, the characteristics of the display elements change with time. Such characteristic variation of the drive transistors, and such characteristic changing of the elements constituting the pixel such as the display elements, exert an influence on the emission luminance. That is to say, if image signals at the same level are supplied to all of the pixels, every pixel should emit light with the same luminance and thus uniformity of the picture should be obtained. However, the characteristic variation in the drive transistors and characteristic changing of the display elements impair the uniformity of the screen. In view of this, for example, Japanese Patent No. 4240059 and Japanese Patent No. 4240068 propose a technique which corrects display nonuniformity caused by factors such as the characteristic variation in the elements constituting the pixel circuits, for example the transistors and display elements, in order to control the emission luminance to be uniform over the entire screen of the display device.

SUMMARY

However, it was found out that in some cases uniformity of a picture is impaired owing to turn ON of an electrooptic element during the process of supplying a current to a hold capacitor through a drive transistor while writing a drive voltage corresponding to the video signal into the hold capacitor.

It is therefore desirable to provide a technique that can suppress display nonuniformity owing to turn ON of an electrooptic element during the process of supplying a current to a hold capacitor through a drive transistor while writing a drive voltage corresponding to the video signal into the hold capacitor.

According to an embodiment of the present disclosure, there is provided a pixel circuit, including: an electrooptic element; a hold capacitor; a write transistor writing a drive voltage corresponding to a video signal supplied to one of main electrode terminals thereof to the hold capacitor; and a drive transistor driving the electrooptic element in accordance with the drive voltage written to the hold capacitor, a control input terminal thereof being connected to one terminal of the hold capacitor at a first node, wherein one of main electrode terminals of the drive transistor, the other terminal of the hold capacitor, and one terminal of the electrooptic element are electrically connected to a second node, and the pixel circuit is adapted such that it can suppress turn ON of the electrooptic element during first processing supplying a current to the hold capacitor through the drive transistor while the drive voltage corresponding to the video signal is written to the hold capacitor through the write transistor. The pixel circuit according to this embodiment of the present disclosure may take various actual configurations with the above configuration on the base.

According to another embodiment of the present disclosure, there is provided a display device, including: display elements in an array, the display elements each including an electrooptic element, a hold capacitor, a write transistor operative to write into the hold capacitor a drive voltage corresponding to a video signal supplied to one of main electrode terminals of the write transistor, and a drive transistor operative to drive the electrooptic element in accordance with the drive voltage written to the hold capacitor, a control input terminal of the drive transistor being connected to one terminal of the hold capacitor at a first node, one of main electrode terminals of the drive transistor, the other terminal of the hold capacitor, and one terminal of the electrooptic element are electrically connected to a second node; and a control portion operative to suppress the electrooptic element being turned ON in conjunction with first processing supplying a current to the hold capacitor through the drive transistor while the drive voltage corresponding to the video signal is written to the hold capacitor through the write transistor. The display device according to this embodiment of the present disclosure may take various actual configurations with the above configuration on the basis. Further, the display device of this embodiment may incorporate any of the various techniques and methods which the pixel circuit according to the embodiment described above may employ.

According to still another embodiment of the present disclosure, there is provided an electronic apparatus, including: a pixel portion including display elements in an array, the display elements each including an electrooptic element, a hold capacitor, a write transistor operative to write into the hold capacitor a drive voltage corresponding to a video signal supplied to one of main electrode terminals of the write transistor, and a drive transistor operative to drive the electrooptic element in accordance with the drive voltage written to the hold capacitor, a control input terminal of the drive transistor being connected to one terminal of the hold capacitor at a first node, one of main electrode terminals of the drive transistor, the other terminal of the hold capacitor, and one terminal of the electrooptic element being electrically connected to a second node; a signal generator operative to generate the video signal supplied to the pixel portion; and a control portion operative to suppress the electrooptic element being turned ON in conjunction with first processing supplying a current to the hold capacitor through the drive transistor while the drive voltage corresponding to the video signal is written to the hold capacitor through the write transistor. The electronic apparatus according to this embodiment of the present disclosure may incorporate any of the various techniques and methods which the pixel circuit according to the embodiment described above may employ.

According to yet another embodiment of the present disclosure, there is provided a method of driving a pixel circuit including a drive transistor driving an electrooptic element, the method including suppressing turn ON of the electrooptic element during processing supplying a current to a hold capacitor through the drive transistor while a drive voltage corresponding to a video signal is written to the hold capacitor. The method of driving a pixel circuit according to this embodiment of the present disclosure may incorporate any of the various techniques and methods which the pixel circuit according to the embodiment described above may employ.

In short, with the technique disclosed herein, the electrooptic element is controlled so as not to turn ON during the process of supplying a current to the hold capacitor through the drive transistor while writing a drive voltage corresponding to the video signal into the hold capacitor. The electrooptic element is prevented from being turned ON for a certain period of time corresponding to the process of supplying a current to the hold capacitor through the drive transistor while writing a drive voltage corresponding to the video signal to the hold capacitor. The "certain period of time" can be determined such that the electrooptic element would not turn ON even when current is applied to the electrooptic element for that period of time. Prior to the process of supplying a current to the hold capacitor through the drive transistor while writing a drive voltage corresponding to the video signal to the hold capacitor, the electrooptic element can be set in a reverse bias state so that the electrooptic element would not turn ON until before the subsequent light emitting period. Thus, it is possible to prevent display nonuniformity due to turn ON of an electrooptic element.

As set forth hereinabove, according to the embodiments of the present disclosure, it is possible to suppress display nonuniformity phenomenon owing to turn ON of an electrooptic element during the process of supplying a current to the hold capacitor through the drive transistor while writing a drive voltage corresponding to the video signal to the hold capacitor.

DETAILED DESCRIPTION OF THE PREFERRED EMBODIMENTS

Figure 1:
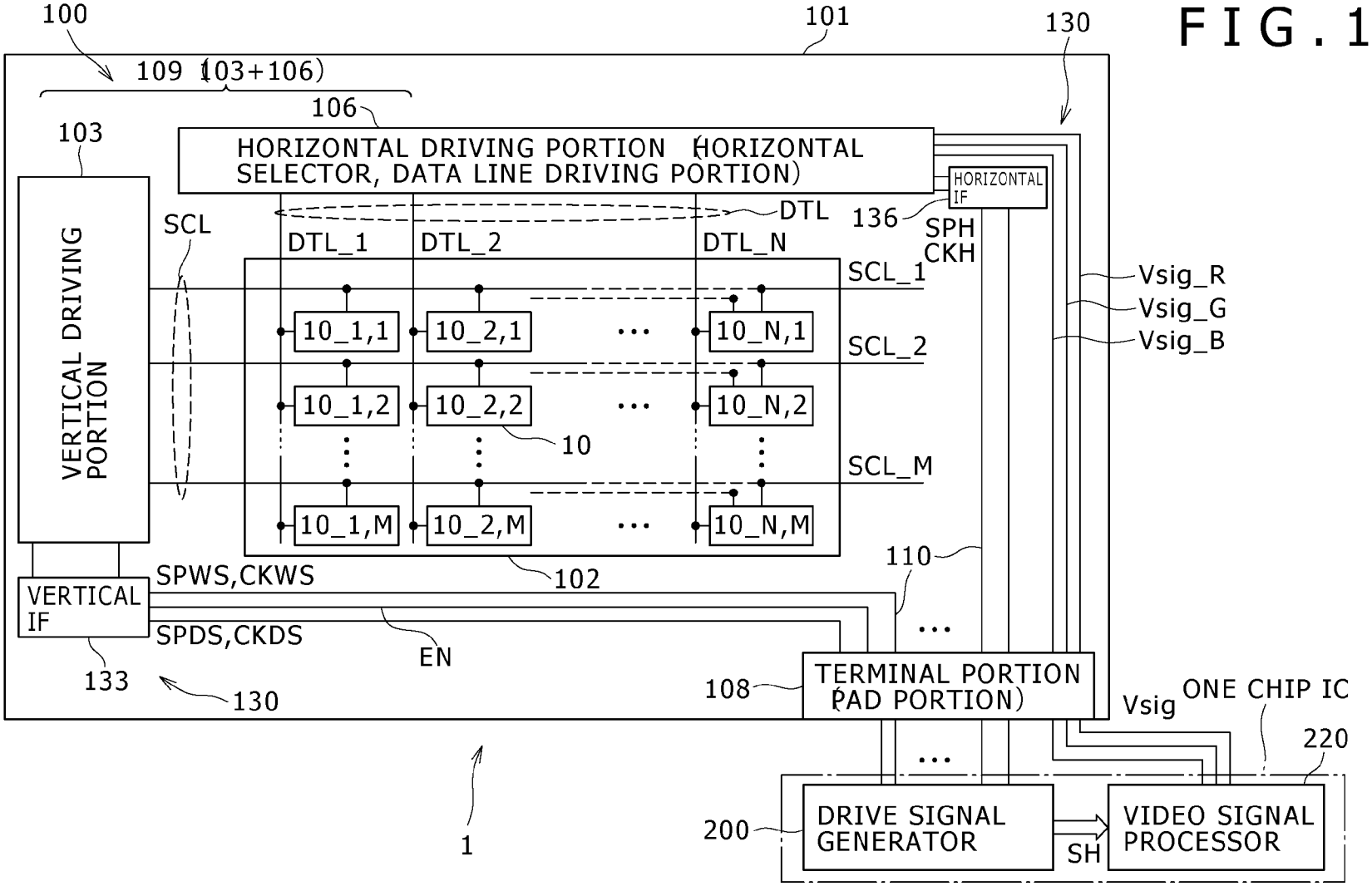
FIG. 1 is a block diagram showing a schematic configuration of an active matrix type display device as a display device according to a first embodiment of the present disclosure.

Embodiments of the present disclosure will be described in detail hereinafter with reference to the accompanying drawings. When functional elements are to be distinguished from one another between different modes, the functional elements are distinguished by adding thereto an alphabet or "_n" (n: numerical character), or suffixes of a combination thereof. On the other hand, when functional elements are to be described without being especially distinguished, such suffixes are omitted. This also applies to the accompanying drawings.

The description will be given below in the following order.

1. Whole Outline
2. Outline of Display Device
2-1. Display Device (First Embodiment)
2-2. Light Emitting Element (Pixel Circuit) (Second Embodiment)
2-3. Method of Driving Light Emitting Element: Basis (Third Embodiment)
3. Electronic Apparatus (Fourth Embodiment)
4. Concrete Examples: Measures to cope with a display nonuniformity phenomenon owing to that an electrooptic element is turned ON
4-1. Example 1: An electric potential at one terminal of the electrooptic element in a phase of start of mobility correction is controlled so as to become a low electric potential
4-2. Example 2: Example 1+initialization independent scanning
5. Examples of Application
5-1. Example 1 of Application
5-2. Example 2 of Application
5-3. Example 3 of Application
5-4. Example 4 of Application
5-5. Example 5 of Application
6. Constitutions of the Present Disclosure

1. WHOLE OUTLINE

First, basic points will be described hereafter. A pixel circuit, a display device, or an electronic apparatus configured according to any of the embodiments of the present disclosure includes an electrooptic element (display portion), a hold capacitor, a write transistor, and a drive transistor. The write transistor writes a drive voltage corresponding to a video signal supplied to one of its main electrode terminals to the hold capacitor. The drive transistor has its control input terminal connected to one terminal of the hold capacitor at a first node, and drives the electrooptic element in accordance with the drive voltage written to the hold capacitor. One of the main electrode terminals of the drive transistor, the other terminal of the hold capacitor, and one terminal of the electrooptic element are all electrically connected to a second node. And in such configuration, turn ON of the electrooptic element is suppressed during first processing, that is, a process of supplying a current to the hold capacitor through the drive transistor while writing a drive voltage corresponding to the video signal to the hold capacitor through the write transistor. In other words, the operation of a pixel circuit is controlled in such a way that the electrooptic element is prevented from being turned ON during a first processing period of time.

As to suppress turn ON of the electrooptic element during the first processing, the electrooptic element may be previously controlled, before the first processing starts, to a reverse bias state to such a degree that the electrooptic element will not turn ON during the first processing. "Such a degree that the electrooptic element will not turn ON" means a degree that the electrooptic element will not turn ON for a certain period of time corresponding to the process of supplying the current to the hold capacitor through the drive transistor while writing the drive voltage corresponding to the video signal to the hold capacitor. It suffices if the electrooptic element is prevented from being turned ON for the certain period of time, or in other words, even if a current is applied to the electrooptic element during the concerned period of time, it suffices if the current flow is interrupted before the electrooptic element turns ON. Therefore, the degree of "the reverse bias state" and the range of "the certain period of time" are to be determined based on this condition. It is then possible to prevent turn ON of the electrooptic element during the period of time for the process of supplying a current to the hold capacitor through the drive transistor while a drive voltage corresponding to a video signal is written to the hold capacitor. As a result, display nonuniformity due to turn ON of an electrooptic element can be prevented.

As the constituent members capable of suppressing turn ON of the electrooptic element during the first process, the pixel circuit preferably includes therein a transistor and other electronic members as appropriate. That is to say, it is preferable that the pixel circuit, the display device or the electronic apparatus includes a control portion for preventing the electrooptic element from being turned ON in conjunction with the first processing for supplying a current to the hold capacitor through the drive transistor while a drive voltage corresponding to a video signal is written to the hold capacitor.

The control portion, for example, may have a configuration including a threshold voltage correction control transistor between the first node and the other electrode terminal of the drive transistor for controlling a second process, which is a process of correcting the threshold voltage of the drive transistor. Regarding ON/OFF-controlling of the threshold voltage correction control transistor, the control may be carried out in conjunction with a write drive pulse or any other suitable control pulse in accordance with which the write transistor is controlled. Alternatively, the control may be carried out independently of a write drive pulse or the like in accordance with which the write transistor is controlled. The functional portion for ON/OFF-controlling the threshold voltage correction control transistor may be formed of a threshold voltage correction control scanning portion. The threshold voltage correction control transistor may be either of an n-channel type or a P-channel type, and the polarity of the control pulse can be set according to the type of the transistor.

The control portion, for example, may adopt a configuration including a coupling capacitor between the second node and the other main electrode terminal of the write transistor. A video signal is supplied to the second node through the write transistor and the coupling transistor. Preferably, the capacitance of the coupling capacitor is substantially equivalent to that of the hold capacitor.

The control portion, for example, may adopt a configuration in which an initialization voltage for the second process is supplied to the coupling capacitor through the write transistor in the second process for correcting the threshold voltage of the drive transistor. Not only the video signal but also the initialization voltage is supplied to the second node through the write transistor and the coupling capacitor.

Alternatively, the control portion, for example, may adopt a configuration including an initialization transistor for supplying the initialization voltage to the coupling capacitor in the second process for correcting the threshold voltage of the drive transistor. A video signal is supplied to the second node through the write transistor and the coupling transistor, whereas the initialization voltage is supplied to the second node through the initialization transistor and the coupling capacitor. Regarding ON/OFF-controlling of the initialization transistor, the control may be carried out in conjunction with a write drive pulse or any other suitable control pulse in accordance with which the write transistor is controlled. Alternatively, the control may be carried out independently of a write drive pulse or the like in accordance with which the write transistor is controlled. As the functional portion for ON/OFF-controlling the initialization transistor, an initialization scanning portion may be provided. The initialization control transistor may be either of an re-channel type or a p-channel type, and the polarity of the control pulse can be set according to the type of the transistor.

Preferably, in the configuration of supplying the initialization voltage to the second node through the coupling capacitor, the polarity for the initialization voltage of the video signal can be set such that the electrooptic element can be controlled to a reverse bias state before start of the first process.

Further, the control portion, for example, may adopt a configuration including a light emission control transistor between the other main electrode terminal of the drive transistor and a power source line. As the functional portion for ON/OFF-controlling the light emission control transistor, a light emission control scanning portion can be provided. The light emission control transistor may be either of an n-channel type or a p-channel type, and the polarity of the control pulse can be set in accordance with the type of the transistor.

Regarding the device configuration, it may have one pixel circuit (electrooptic element), or may have a pixel portion in which electrooptic elements are disposed in a line or in a two-dimensional matrix. In the case of a configuration including a pixel portion, it is preferable to provide a control portion for preventing the electrooptic element from being turned ON in conjunction with the process of supplying a current to the hold capacitor through the drive transistor while writing a drive voltage corresponding to the video signal to the hold capacitor. A scanning portion forming a part of the control portion is preferred to be provided separately from the electrooptic element (display portion). Thus, in the case of a configuration having a pixel portion, in which electrooptic elements are disposed in a two-dimensional matrix, turn ON of the display portions can be prevented by scan processing each row.

The electrooptic element may be a light emitting element incorporating a light emitting portion of a self-emitting type as the display portion thereof. Examples of such a light emitting portion are an organic electroluminescence light emitting portion, an inorganic electroluminescence light emitting portion, an LED light emitting portion or a semiconductor laser light emitting portion. In particular, the organic electroluminescence light emitting portion is suitable.

2. OUTLINE OF DISPLAY DEVICE

In the following description, in order to facilitate understanding of the correspondence relationships, a resistance value, a capacitance (electrostatic capacitance), and the like of members composing a circuit are designated by the same reference symbols as those added to these members, respectively.

[Basis]

Firstly, the outline of a display device including a light emitting element (elelecrooptic element) is described. In the descriptions of circuit configurations described below, the wording "electrically connected" is simply described as "connected." The meaning of the wording "electrically connected" is not limited to a direct connection and it includes connection through a transistor (e.g., a switching transistor) or any other suitable electric element (either an active element or a passive element).

The display device includes a plurality of pixel circuits (may also simply referred to as "pixels"). Each of the pixel circuits incorporates a display element (electrooptic element) including a display portion (light emitting portion) and a driving circuit for driving the display portion. The display portion may be a light emitting element including a light emitting portion of a self-emitting type. Examples of the light emitting portion are an organic electroluminescence light emitting portion, an inorganic electroluminescence light emitting portion, an LED light emitting portion and a semiconductor laser light emitting portion. It is noted that although a constant current drive type is adopted as the system for driving the light emitting portion of the display element, in principle, the system is not limited to the constant current drive type and may instead be a constant voltage drive type.

In the following case, a description will be given of a case where the display device employs an organic electroluminescence light emitting portion as the light emitting element. More specifically, it is an organic electroluminescence light emitting element (organic EL element) having a laminated structure of the driving circuit and the organic electroluminescence light emitting portion (ELP: light emitting portion) connected to the driving circuit.

Although various kinds of circuits are known as the driving circuit for driving the light emitting portion ELP, the pixel circuit can adopt a configuration including a drive circuit of a 5Tr/1C type, a 4Tr/1C type, a 3Tr/1C type, a 2Tr/1C type or the like. Here, a in the term "αTr/1C type" means the number of transistors, and "1C" means that the capacitance portion includes one hold capacitor $C_{CS}$. The transistors constituting the driving circuit are preferably all n-channel transistors, but the present disclosure is by no means limited thereto, and part of the transistors constituting the driving circuit may also be a p-channel transistor(s). Incidentally, the circuit may be configured by forming transistors on a semiconductor substrate or the like. The structure of the transistors composing the driving circuit is not particularly limited, and it is possible to use an insulated gate field-effect transistor (in general, Thin Film Transistor (TFT)) typified by a MOSFET. In addition, the transistors composing the driving circuit may be any of an enhance type or a depletion type, and may also be any of a single-gate type or a dual-gate type.

In any of the structures described above, the display device basically includes, as minimum constituent elements, components included in a 2Tr/1C type, which are a light emitting portion ELP, a drive transistor $TR_D$, a write transistor $TR_W$ (referred to as "a sampling transistor" as well), a vertical scanning portion including at least a write scanning portion, a horizontal scanning portion having a function of a signal outputting portion, and a hold capacitor $C_{CS}$. Preferably, in order to configure a bootstrap circuit, the hold capacitor $C_{CS}$ is connected between the control input terminal (gate terminal) of the drive transistor $TR_D$ and one (typically, the source terminal) of the main electrode terminals (source and drain regions) thereof. The drive transistor $TR_D$ has one of its main electrode terminals connected to the light emitting portion ELP, and the other to a power source line PWL. A power source voltage (either a steady voltage or a pulse voltage) is supplied to the power source line PWL from a power source circuit or a scanning circuit for the power source voltage or the like.

The horizontal driving portion supplies, to a video signal line DTL (referred to as "data line" as well), a video signal $V_{sig}$ to control the luminance of the light emitting portion ELP, or a video signal VS in the broad sense representing a reference electric potential(s) (not limited to one kind) used for threshold voltage correction or the like. The write transistor $TR_W$ has one of its main electrode terminals connected to the video signal line DTL, and the other of its main electrode terminals to the control input terminal of the drive transistor $TR_D$. The write scanning portion supplies a control pulse (write drive pulse WS) to the control input terminal of the write transistor $TR_W$ through a write scanning line WSL so as to control turn ON and OFF of the write transistor $TR_W$. The point of connection of the other one of the main electrode terminals of the write transistor $TR_W$, the control input terminal of the drive transistor $TR_D$, and one terminal of the hold capacitor $C_{CS}$ is referred to as "a first node $ND_1$." The point of connection between the one of the main electrode terminals of the drive transistor $TR_D$ and the other terminal of the hold capacitor $C_{CS}$ is referred to as "a second node $ND_2$."

2-1. Display Device (First Embodiment)

[Configuration]

Figure 2:
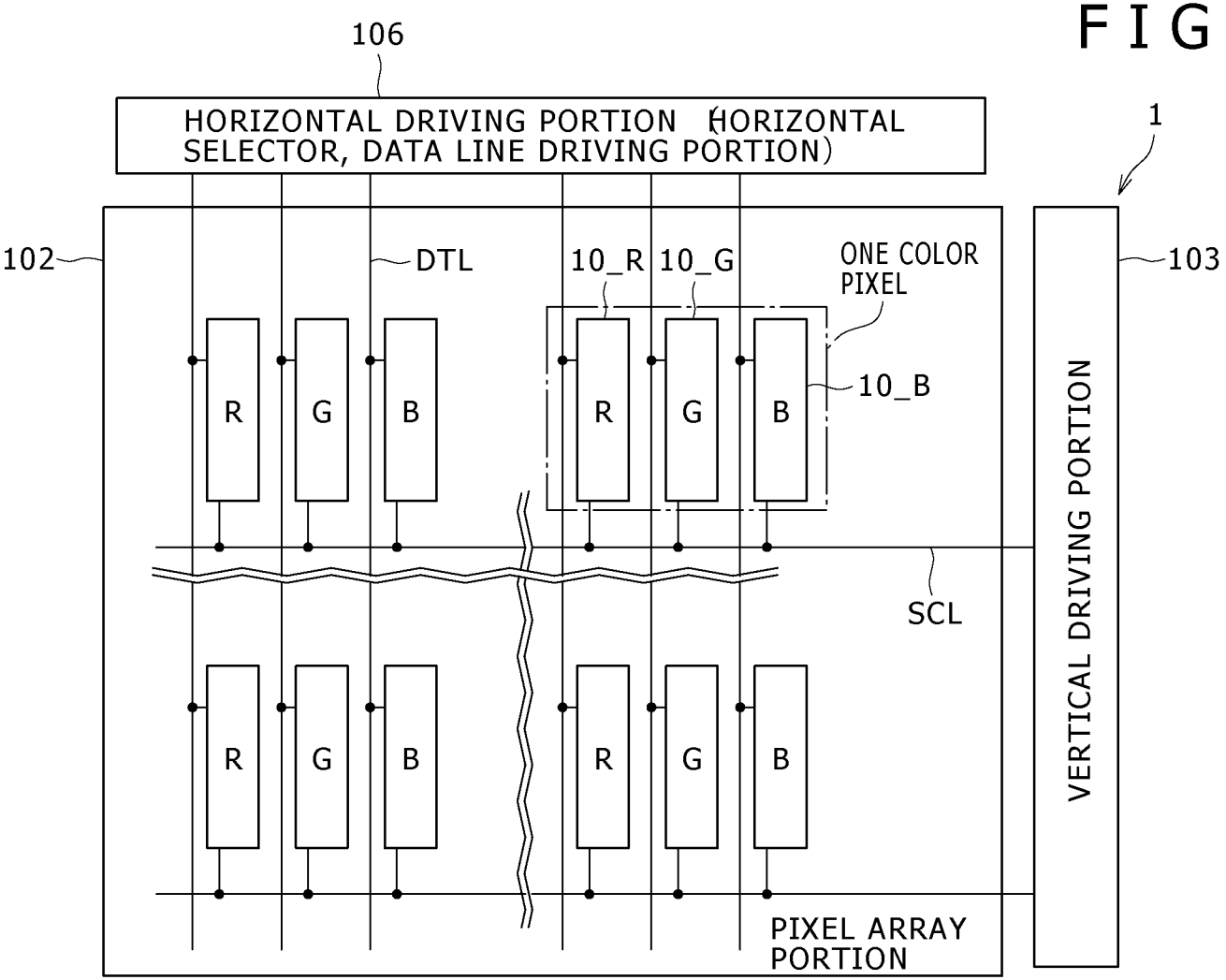
FIG. 2 is a block diagram showing a schematic configuration of an active matrix type display device compatible with color image display as a display device according to a modified change of the first embodiment of the present disclosure.

FIGS. 1 and 2 are block diagrams showing schematic configurations of an active matrix type display device according to a first embodiment of the present disclosure, and a modified change of the first embodiment of the present disclosure. Specifically, FIG. 1 is a block diagram showing a schematic configuration of a common active matrix type display device, and FIG. 2 is a block diagram showing a schematic configuration of the active matrix type display device when it is capable of color image display.

As shown in FIG. 1, the display device 1 includes a display panel portion 100, a drive signal generator (so-called timing generator) 200, and a video signal processor 220. The display panel portion 100 includes pixel circuits 10 (referred to as "pixels" as well) arranged to form an effective image area of a horizontal to vertical aspect ratio of X:Y (for example, 9:16), and each of the pixel circuits 10 incorporates an organic EL element (not shown) as a display element. The drive signal generator 200 is an example of a panel control portion which generates various kinds of pulse signals in accordance with which the display panel portion 100 is driven and controlled. The drive signal generator 200 and the video signal processor 220 are built in a one-chip integrated circuit (IC), and in the example shown here, they are disposed outside the display panel portion 100.

It is noted that the product form is not limited to a module (composite parts) form such as the display device 1 including all of the display panel portion 100, the drive signal generator 200, and the video signal processor 220 as shown in FIG. 1. For example, only the display panel portion 100 may be provided as the display device 1. In addition, the display device 1 may as well be a module display device having an encapsulated configuration. For example, a display module which is formed in such a way that a counter portion such as a transparent glass is attached to the pixel array portion 102 corresponds to such a display device. A color filter, a protective film, a light blocking film, and the like may be provided on the transparent counter portion. The display module may also be provided with a circuit portion, a flexible printed circuit (FPC) board or the like for input/output of a video signal $V_{sig}$ and various kinds of drive pulses from the outside to the pixel array portion 102.

Such a display device 1 can be utilized in the display portion of various kinds of electronic apparatuses in any field, which is operative to display a still image or a moving image (video) formed from a video signal inputted to the electronic apparatus or a video signal generated in the electronic apparatus. For example, the display device can be used in a portable music player utilizing a recording medium such as a semiconductor memory, a mini-disc (MD) or a cassette tape, a digital camera, a notebook-size personal computer, mobile terminal equipment such as a mobile phone, a video camera, and the like.

In the display panel portion 100, a pixel array portion 102, a vertical driving portion 103, a horizontal driving portion 106 (referred to as a "horizontal selector" or a "data line driving portion" as well), an interface portion 130 (IF), a terminal portion 108 (pad portion) for connection to the outside, and the like are formed integrally with one another on a substrate 101. That is to say, a configuration is adopted such that peripheral driving circuits such as the vertical driving portion 103, the horizontal driving portion 106, and the interface portion 130 are formed on the same substrate 101 on which the pixel array portion 102 is formed. A light emitting element (pixel circuit 10) located on an m-th row (m=1, 2, 3, . . . , M) and on an n-th column (n=1, 2, 3, . . . , N) is designated as 10_*n*, m in FIG. 1.

The pixel circuits 10 are disposed in an M (rows)×N (columns) matrix in the pixel array portion 102. The vertical driving portion 103 scans the pixel circuits 10 in the vertical direction. The horizontal driving portion 106 scans the pixel circuits 10 in the horizontal direction. The driving portions (the vertical driving portion 103 and the horizontal driving portion 106) and an external circuit interface with each other through the interface portion 130 (IF). The interface portion 130 includes a vertical IF portion 133 and a horizontal IF portion 136. The vertical driving portion 103 and the external circuit interface with each other through the vertical IF portion 133, whereas the horizontal driving portion 106 and the external circuit interface with each other through the horizontal IF portion 136.

The vertical driving portion 103 and the horizontal driving portion 106 constitute a control portion 109 for controlling writing of a signal electric potential to the hold capacitor, threshold voltage correcting operation, mobility correcting operation, and bootstrap operation. With the control portion 109 and the interface portion 130 (including the vertical IF portion 133 and the horizontal IF portion 136), the drive control circuit operative to control driving of the pixel circuits 10 in the pixel array portion 102 is composed.

When the 2Tr/1C type drive configuration is adopted, the vertical driving portion 103 includes a write scanning portion (a write scanner WS; Write Scan), and a drive scanning portion (a drive scanner DS; Drive Scan) which functions as a power scanner having a power source supplying ability. The pixel array portion 102, for example, is driven from either one side or both sides of the horizontal direction shown in the figure by the vertical driving portion 103. Also, the pixel array portion 102 is driven from either one side or both sides of the vertical direction shown in the figure by the horizontal driving portion 106.

Various kinds of pulse signals are supplied to the terminal portion 108 from the drive signal generator 200 disposed outside the display device 1. The terminal portion 108 also receives video signals $V_{sig}$ supplied from the video signal processor 220. In the case of the display device 1 compatible with color display, a video signal $V_{sig_R}$, a video signal $V_{sig_G}$, and a video signal $V_{sig_B}$ corresponding to each color (in this case, the three primary colors: Red (R); Green (G); and Blue (B)) are supplied to the terminal portion 108 from the video signal processor 220.

As an example of pulses for starting scanning in the vertical direction, shift start pulses SP (two kinds of shift start pulses SPDS and SPWS in the figure) and vertical scanning clocks CK (two kinds of vertical scanning clocks CKDS and CKWS in the figure) are supplied to the terminal portion 108 as pulse signals for vertical driving. In addition, as appropriate, pulse signals such as inverted vertical scanning clocks xCK (two kinds of vertical scanning clocks xCKDS and xCKWS in the figure), and an enable pulse used to instruct output of a pulse at a specific timing are supplied to the terminal portion 108 as pulse signals for vertical driving. As for pulse signals for horizontal driving, pulses for starting scanning in the horizontal direction such as a horizontal start pulse SPH and a horizontal scanning clock CKH, and as appropriate, an inverted horizontal scanning clock xCKH and an enable pulse used to instruct output of a pulse at a specific timing are supplied to the terminal portion 108.

Terminals of the terminal portion 108 are connected to the vertical driving portion 103 and the horizontal driving portion 106 through wirings 110. For example, after the pulses supplied to the terminal portion 108 have been internally adjusted in voltage levels thereof in a level shifter portion (not shown) as appropriate, the resulting pulses are supplied to the horizontal driving portion 106 and the portions in the vertical driving portion 103.

Although not specifically illustrated here (details will be described later), the pixel array portion 102 is configured in such a way that the pixel circuits 10, provided with pixel transistors for the organic EL elements as display elements, are two-dimensionally disposed in a matrix, and the vertical scanning lines SCL are wired so as to correspond to the rows of the pixel array, respectively, whereas the video signal lines DTL are wired so as to correspond to the columns of the pixel array, respectively. In brief, the pixel circuits 10 are connected to the vertical driving portion 103 through the vertical scanning lines SCL, and are also connected to the horizontal driving portion 106 through the video signal lines DTL. Specifically, for the pixel circuits 10 disposed in a matrix, the vertical scanning lines SCL_1 to SCL_M for M rows, which are driven in accordance with the drive pulses by the vertical driving portion 103, are wired so as to respectively correspond to the pixel rows. The vertical driving portion 103 is composed of a combination of logic gates (including a latch, a shift register, and the like as well), and selects the pixel circuits 10 in the pixel array portion 102 by rows. That is to say, the vertical driving portion 103 successively selects pixel circuits 10 through the vertical scanning lines SCL in accordance with the pulse signals for the vertical drive system supplied from the drive signal generator 200. The horizontal driving portion 106 is composed of a combination of logic gates (including a latch, a shift register, and the like as well), and selects the pixel circuits 10 in the pixel array portion 102 by columns. That is to say, the horizontal driving portion 106 samples a predetermined electric potential (for example, a video signal $V_{sig}$ level) within the video signal VS through the video signal lines DTL for the selected pixel circuits 10 and writes the sampled predetermined electric potential to each of the hold capacitors $C_{CS}$ in accordance with the pulse signals of the horizontal drive system supplied from the drive signal generator 200.

The display device 1 of the first embodiment can carry out line-sequential drive or point-sequential drive. Thus, the write scanning portion 104 and drive scanning portion 105 of the vertical driving portion 103 scan the pixel array portion 102 line-by-line (i.e., by rows). Synchronously with this scanning, the horizontal driving portion 106 either simultaneously writes the video signals for one horizontal line (in the case of the line-sequential driving) or writes the video signals pixel-by-pixel (in the case of the point-sequential driving) in the pixel array portion 102.

In order to be capable of color image display, for example, as shown in FIG. 2, the pixel array portion 102 incorporates a pixel circuit 10$_{_R}$, a pixel circuit 10$_{_G}$, and a pixel circuit 10$_{_B}$ as sub-pixels corresponding to each color (the three primary colors: Red (R); Green (G); and Blue (B) in this case) and disposed in a longitudinal stripe form in a predetermined order. One color pixel is composed of one set of sub-pixels each corresponding to a respective color. Although the layout in this case is of a stripe structure, in which the sub-pixels respectively corresponding to the colors are disposed in a longitudinal stripe form, this is only an example of the layout of sub-pixels and the layout is by no means limited to such a disposition example. For example, a form may also be adopted in which the sub-pixels are shifted in the vertical direction.

Note that, referring to FIGS. 1 and 2, a configuration is adopted in which the vertical driving portion 103 (specifically, the constituent elements thereof) is disposed on only one side of the pixel array portion 102. However, it is possible to adopt a configuration in which the constituent elements of the vertical driving portion 103 are disposed on the right-hand and left-hand sides, respectively, so as to sandwich the pixel array portion 102 between them. In addition, it is also possible to adopt a configuration in which ones and the others of the constituent elements of the vertical driving portions 103 are disposed on the right-hand and left-hand sides, respectively, separately from each other. Likewise, referring to FIGS. 1 and 2, a configuration is shown in which the horizontal driving portion 106 is disposed on only one side of the pixel array portion 102. However, it is also possible to adopt a configuration in which the horizontal driving portion 106 are disposed on upper and lower sides, respectively, so as to sandwich the pixel array portion 102. In the example shown in FIG. 1, a configuration is adopted in which the pulse signals such as the vertical shift start pulse, the vertical scanning clock pulse, the horizontal start pulse, and the horizontal scanning clock are all inputted from the outside of the display panel portion 100. However, the drive signal generator 200 for generating these various timing pulses can also be mounted on the display panel portion 100.

The configuration shown in the figure is merely one form of the display device, and thus any other suitable form can be taken as the product form. That is to say, it suffices if the display device is configured so as to include, as a whole, the pixel array portion in which the elements composing the pixel circuits 10 are disposed in a matrix; the control portion including, as a main portion, the scanning portion connected to the scanning lines for driving the pixels; the drive signal generator for generating the various kinds of signals in accordance with which the control portion is operated; and the video signal processor. One possible product form is the form shown in the figure, configured such that the drive signal generator and the video signal processor are provided separately from the display panel portion in which the pixel array portion and the control portion are mounted on the same substrate (for example, a glass substrate) (this configuration is referred to as an "on-panel-disposition configuration"). It is also possible to adopt a form in which the pixel array portion is mounted on the display panel portion, and the peripheral circuits such as the control portion, the drive signal generator, and the video signal processor are mounted on another board (for example, a flexible board) separate from the substrate of the display panel portion (referred to as a "peripheral circuits panel-outside-disposition configuration"). In addition, in the case of the on-panel-disposition configuration in which the display panel portion incorporates the pixel array portion and the control portion on the same substrate, it is also possible to adopt a form in which the transistors for the control portion (and also the drive signal generator and the video signal processor as may be necessary) are simultaneously formed in the process of forming the TFTs of the pixel array portion (referred to as "a transistor integration configuration"). Further, it is possible to adopt a form in which a semiconductor chip for the control portion (and also the drive signal generator and the video signal processor as may be necessary) is directly mounted on the substrate on which the pixel array portion is mounted by utilizing a Chip On Glass (COG) mounting technique (referred to as "a COG mounting configuration"). In addition, only the display panel portion (including at least the pixel array portion) can be provided as a display device.

In the first embodiment of the present disclosure, in the display device 1 further includes a control portion for suppressing that the electrooptic element is turned ON in conjunction with first processing for supplying the current to the hold capacitor through the drive transistor while the drive voltage corresponding to the video signal is written to the hold capacitor through said write transistor. Thus, there is provided the effect that the operation of the pixel circuit is controlled in such a way the electrooptic element is prevented from being turned ON for the first processing period of time.

2-2. Light Emitting Element: Pixel Circuit (Second Embodiment)

Figure 3:
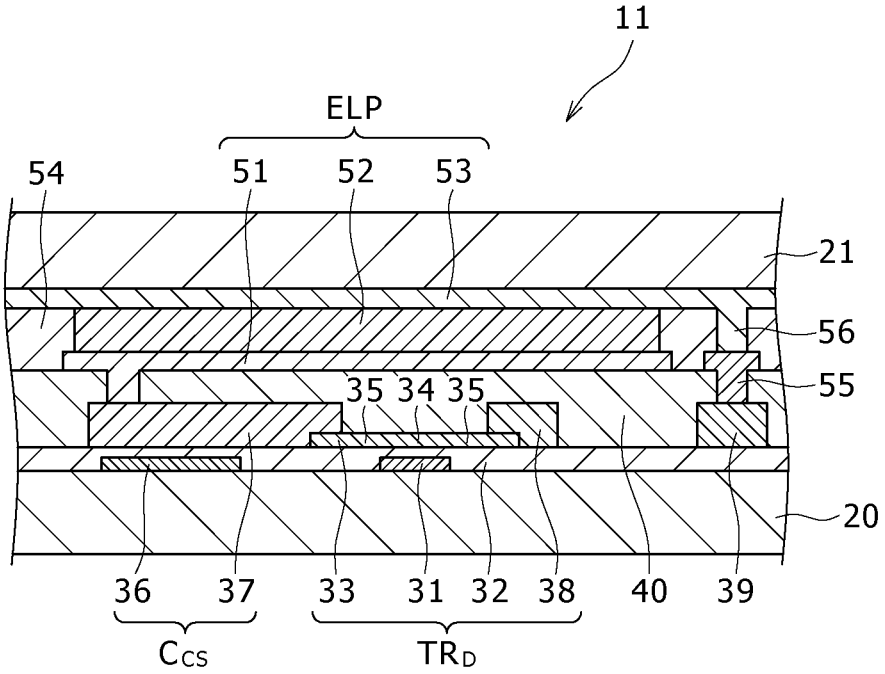
FIG. 3 is a partial cross sectional views showing a structure of a light emitting element (substantially, a pixel circuit) according to a second embodiment of the present disclosure.

FIG. 3 is a partial cross sectional view illustrating the structure of a light emitting element 11 (substantially, the pixel circuit 10) including a driving circuit. FIG. 3 is a schematic partial cross sectional view of a part of the light emitting element 11 (the pixel circuit 10). The insulated gate field-effect transistor shown in FIG. 3 is a thin film transistor (TFT). Although not illustrated, either a so-called back-gate type thin film transistor or a MOS transistor may also be used.

The transistors and capacitance portion (hold capacitor $C_{CS}$) composing the driving circuit of each light emitting element 11 are formed on a supporting body 20. The light emitting portion ELP is formed, for example, above the transistors and the hold capacitor $C_{CS}$ composing the drive circuit through an interlayer insulating layer 40. One of the source and drain regions of the drive transistor $TR_D$ is connected to an anode electrode of the light emitting portion ELP through a contact hole. In FIG. 3, only the drive transistor $TR_D$ is illustrated. A write transistor $TR_W$ and other transistors stay in hiding and are invisible. The light emitting portion ELP has the well-known constitution and structure, and may include, for example, an anode electrode, a hole transport layer, a light emitting layer, an electron transport layer, a cathode electrode, etc.

Specifically, the drain transistor $TR_D$ is composed of a gate electrode 31, a gate insulating layer 32, a semiconductor layer 33, source and drain regions 35 provided in the semiconductor layer 33, and a channel formation region 34 to which the portion of the semiconductor layer 33 between the source and drain regions 35 corresponds. The hold capacitor $C_{CS}$ is composed of the other electrode 36, a dielectric layer formed of an extension portion of the gate insulating layer 32, and the one electrode 37 (corresponds to a second node $ND_2$). The gate electrode 31, a part of the gate insulating layer 32, and the other electrode 36 constituting the hold capacitor $C_{CS}$ are all formed on the supporting body 20. One of the source and drain regions 35 of the drive transistor $TR_D$ is connected to a wiring 38, and the other of the source and drain regions 35 of the drive transistor $TR_D$ is connected to the other electrode 37. The drive transistor $TR_D$, the hold capacitor $C_{CS}$, and the like are all corrected with an interlayer insulating layer 40. Also, the light emitting portion ELP composed of the anode electrode 51, the hole transport layer, the light emitting layer, the electron transport layer, and the cathode electrode 53 is provided on the interlayer insulating layer 40. In FIG. 3, the hole transport layer, the light emitting layer, and the electron transport layer are illustrated as one layer 52. A second interlayer insulating layer 54 is provided on a portion of the interlayer insulating layer 40 on which no light emitting portion ELP is provided. Also, a transparent substrate 21 is disposed on the second interlayer insulating layer 54 and the cathode electrode 53. Thus, a light emitted from the light emitting layer is transmitted through the substrate 21 to be emitted to the outside. One electrode 37 and the anode electrode 51 are connected to each other through a contact hole provided in the interlayer insulating layer 40. The cathode electrode 53 is connected to a wiring 39 provided on the extension portion of the gate insulating layer 32 through a contact hole 56 and a contact hole 55 which are provided in the second interlayer insulating layer 54 and the interlayer insulating layer 40, respectively.

In the second embodiment of the present disclosure, in the pixel circuit 10, it is adapted to suppress that the electrooptic element (organic EL element) is turned ON during the first processing for supplying the current to the hold capacitor $C_{CS}$ through the drive transistor $TR_D$ while the drive voltage corresponding to a video signal $V_{sig}$ which will be described later is written to the hold capacitor $C_{CS}$ through a write transistor $TR_W$ which will be described later. Thus, there is provided the effect that the operation of the pixel circuit is controlled in such a way the electrooptic element is prevented from being turned ON for the first processing period of time.

2-3. Method of Driving Pixel Circuit: Basis (Third Embodiment)

A method of driving the light emitting portion (pixel circuit) will be described hereinafter. The method of driving the light emitting portion is substantially a method of driving the display device 1 according to the first embodiment of the present disclosure. For facilitating understanding, it is assumed in the subsequent description that the pixel circuit is configured as follows. First, each of the transistors composing the pixel circuit 10 is an n-channel transistor. In addition, it is supposed that the anode terminal of the light emitting portion ELP is connected to a second node $ND_2$, and the cathode terminal thereof is connected to a cathode wiring, which is denoted as "cath" in the subsequent figures (the electric potential thereof is defined as cathode electric potential $V_{cath}$). The light emission state (luminance) of the light emitting portion ELP is controlled in accordance with the magnitude of the value of a drain current $I_{ds}$. Concerning the light emission state of the light emitting portion, of the two main electrode terminals (source and drain regions) of the drive transistor $TR_D$, one main electrode terminal (the one on the anode side of the light emitting portion ELP) acts as a source terminal (source region), and the other main electrode terminal acts as a drain terminal (drain region). The display device is a display device compatible with color image display, and incorporates the pixel circuits 10 which are disposed in a two-dimensional (N/3)×M matrix. One pixel circuit forming one unit of the color image display is composed of three sub-pixel circuits: a red color light emitting pixel circuit $10_{_R}$ for emitting red color light; a green color light emitting pixel circuit $10_{_G}$ for emitting green color light; and a blue color light emitting pixel circuit $10_{_B}$ for emitting blue color light. The light emitting elements composing the pixel circuits 10 are driven sequentially line-by-line, and the display frame rate is FR (time/sec). That is to say, the light emitting elements of (N/3) pixel circuits 10 disposed in an m-th row (m=1, 2, 3, . . . , M), or more specifically, N sub-pixel circuits 10 are driven at the same time. In other words, the timing of emission/non-emission of light emitting elements composing one row is controlled in a unit of one row. The process for writing video signals to the pixel circuits 10 composing one row may either be done by simultaneously writing the video signals to all of the pixel circuits 10 (referred to as "simultaneous write processing" as well), or by successively writing a video signal to each pixel circuit 10 (referred to as "successive write processing" as well). The type of processing can be suitably selected depending on the configuration of the drive circuit.

Here, a description will be given of the driving operation for a light emitting element (pixel circuit 10) located in an m-th row and in an n-th column (n=1, 2, 3, . . . N). The light emitting element located in the m-th row and in the n-th column is referred to as either the (n, m)-th light emitting element or the (n, m)-th light emitting pixel circuit. Various kinds of processing (such as threshold voltage correcting processing, write processing, and mobility correcting processing) are executed up to the end of a horizontal scanning period of time (an m-th horizontal scanning period of time) for the light emitting elements disposed in the m-th row. Incidentally, the write processing and the mobility correcting processing should be executed within the m-th horizontal scanning period of time. On the other hand, the threshold voltage correcting processing and preprocessing accompanying the threshold voltage correcting processing can be executed prior to the m-th horizontal scanning period of time depending on the kind of the drive circuit.

After all of the various kinds of processing are finished, the light emitting portions forming the light emitting elements disposed in the m-th row are caused to emit light. Incidentally, after finishing all of the various kinds of processing, the light emitting portions may be immediately caused to emit light, or alternatively, the light emitting portions may be caused to emit light after a lapse of a predetermined period of time (for example, a horizontal scanning period of time for a predetermined number of rows). The "predetermined period of time" can be set depending on the specification of the display device, the configuration of the pixel circuit 10 (in a word, the drive circuit), and the like. In the following description, for the sake of convenience of description, it is assumed that after all of the various kinds of processing are completed, the light emission portions are immediately caused to emit light. Light emission of the light emitting portions composing the light emitting elements disposed in the m-th row is continued until right before of the start of the horizontal scanning period of time for the light emitting elements disposed in the (m+m')-th row. "m'" may be determined depending on the design and specification of the display device. That is to say, the light emission of the light emission portions composing the light emitting elements disposed in the m-th row of a certain display frame is continued until an (m+m'−1)-th horizontal scanning period of time. Meanwhile, in principle, the light emission portions composing the light emitting elements disposed in the m-th row maintain a non-light emission state until the end of the write processing and the mobility correcting processing within a period of time from the start of the (m+m')-th horizontal scanning period of time to the m-th horizontal scanning period of time for the next display frame. As the period of time of a non-light emission state (referred to as "anon-emission period of time" as well) is provided, the residual image blurring accompanying the active matrix driving is reduced, and thus the moving image quality can be more satisfactory. However, the light emission state/non-light emission state of each of the pixel circuits 10 (light emitting elements) is not limited to the state which has been described so far. The time length of the horizontal scanning period of time is a time length shorter than (1/FR)×(1/M) sec. When the value of (m+m') exceeds M, the rest of the time of the horizontal scanning period exceeding the value of (m+m') is processed in the next display frame.

The wording "the transistor is held in an ON state (in a conduction state)" means a state in which a channel is formed between the main electrode terminals (the source and drain regions), and it does not matter whether or not a current is flowing from one main electrode terminal to the other main electrode terminal. On the other hand, the wording "the transistor is held in an OFF state (in a non-conduction state)" means that no channel is formed between the main electrode terminals. The wording "a main electrode terminal of a certain transistor is connected to a main electrode terminal of another transistor" implies a form in which a source/drain region of a certain transistor, and a source/drain region of another transistor occupy the same region. Further, the source/drain region can be formed of not only a conductive material such as poly silicon or amorphous silicon containing therein an impurity, but also of a layer made of a metal, an alloy, a conductive particle, a lamination structure of those, or a layer made of an organic material (conductive polymer). Incidentally, in the timing charts which will be used in the following description, the length (time length) of the horizontal lines representing various time periods is schematic, and thus does not represent the rate of time lengths of the time periods.

The method of driving the pixel circuit 10 includes a preprocessing process, a threshold voltage correcting processing process, a video signal writing processing process, a mobility correcting process, and a light emission process. The preprocessing process, the threshold voltage correcting processing process, the video signal writing processing process, and the mobility correcting process are collectively referred to as "a non-light emission process" as well. The video signal writing processing and the mobility correcting process are executed at the same time depending on the configuration of the pixel circuit 10 in some cases. Hereinafter, these processes will be outlined.

In the light emission state of the light emitting element, the drive transistor $TR_D$ is driven so as to cause a drain current $I_{ds}$ to flow in accordance with Expression (1):

$$I_{ds}=k\times\mu\times(V_{gs}-V_{th})^2 \quad (1)$$

where μ is an effective mobility, $V_{gs}$ is an electric potential difference (gate-to-source voltage) between an electric potential (a gate electric potential $V_g$) at a control electrode terminal and an electric potential (a source electric potential $V_s$) at a source terminal, $V_{th}$ is a threshold voltage, and k is a coefficient. In this case, the constant k is given by Expression (2):

$$k=(1/2)\times(W/L)\times C_{ox} \quad (2)$$

where W is a channel with, L is a channel length, and $C_{ox}$ is an equivalent capacitance ((relative permittivity of the gate insulating layer)×(permittivity of vacuum)/(thickness of the gate insulating layer)).

The drain current $I_{ds}$ flows through the light emitting portion ELP, whereby the light emitting portion ELP emits light.

The light emission state (luminance) of the light emitting portion ELP is controlled in accordance with the magnitude of the value of the drain current $I_{ds}$. In the light emission state of the light emitting element, of the two main electrode terminals (source and drain regions) of the drive transistor $TR_D$, one main electrode terminal (one on the anode terminal side of the light emitting portion ELP) acts as a source terminal (source region), and the other main electrode terminal acts as a drain terminal (drain region). For the sake of convenience of description, in the following description, the one main electrode terminal of the drive transistor $TR_D$ is simply referred to as a "source terminal" and the other main electrode terminal is simply referred to as a "drain terminal" in some cases.

In the following description, unless otherwise stated, it is supposed that an electrostatic capacitance $C_{el}$ of a parasitic capacitance of the light emitting portion ELP is a value sufficiently larger than that of each of an electrostatic capacitance $C_{CS}$ of a hold capacitor $C_{CS}$, and an electrostatic capacitance $C_{gs}$ between a gate electrode terminal and a source electrode terminal as an example of a parasitic capacitance of the drive transistor $TR_D$. Thus, a change in the electric potential of the source region (the second node $ND_2$) of the drain transistor $TR_D$ (the source electric potential $V_s$) based on a change in the electric potential at the gate terminal of the drain transistor $TR_D$ (the gate electric potential $V_g$) is not taken into consideration.

[Preprocessing Process]

The preprocessing process is performed so that a difference in electric potential between the first node $ND_1$ and the second node $ND_2$ exceeds the threshold voltage $V_{th}$ of the drain transistor $TR_D$, and a difference in electric potential between the second node $ND_2$ and the cathode electrode included in the light emission portion ELP is prevented from exceeding a threshold voltage $V_{thEL}$ of the light emitting portion ELP. In order to attain this, a first node initialization voltage ($V_{ofs}$) is applied to the first node $ND_1$, and a second node initialization voltage ($V_{ini}$) is applied to the second node $ND_2$. For example, the video signal $V_{sig}$ in accordance with which the luminance of the light emitting portion ELP is controlled is set to the range of 0 to 10 V, a power source voltage $V_{cc}$ is set to 20 V, the threshold voltage $V_{th}$ of the drain transistor $TR_D$ is set to 3 V, a cathode electric potential $V_{cath}$ is set to 0 V, and the threshold voltage $V_{thEL}$ of the light emitting portion ELP is set to 3 V. In this case, the electric potential $V_{ofs}$ used to initialize the electric potential at the control input terminal of the drain transistor $TR_D$ (the gate electric potential $V_g$, i.e., the electric potential at the first node $ND_1$) is set to 0 V, and the electric potential $V_{ini}$ used to initialize the electric potential at the source terminal of the drive transistor $TR_D$ (the source electric potential $V_s$, i.e., the electric potential at the second node $ND_2$) is set to −10 V.

[Threshold Voltage Correcting Processing Process]

In a state in which the electric potential at the first node $ND_1$ is held, the drain current $I_{ds}$ is caused to flow through the drive transistor $TR_D$, whereby the electric potential at the second node $ND_2$ is changed from the electric potential at the first node $ND_1$ toward an electric potential obtained by subtracting the threshold voltage $V_{th}$ of the drive transistor $TR_D$ from the electric potential at the first node $ND_1$. At this phase, a voltage exceeding the voltage obtained by adding the threshold voltage $V_{th}$ of the drive transistor $TR_D$ to the electric potential at the second node $ND_2$ after the preprocessing process (for example, the power source voltage upon light emission) is applied to the other main electrode terminal (on the side opposite to the second node $ND_2$) of the two main electrode terminals of the drive transistor $TR_D$. In this threshold voltage correcting processing process, the extent to which a difference in electric potential between the first node $ND_1$ and the second node $ND_2$ (in other words, the gate-to-source voltage $V_{gs}$ of the drive transistor $TR_D$) comes close to the threshold voltage $V_{th}$ of the drive transistor $TR_D$ is dependent on the time for the threshold voltage correcting processing. Therefore, for example, when a sufficiently long time for the threshold voltage correcting processing is ensured, the electric potential at the second node $ND_2$ would reach the electric potential obtained by subtracting the threshold voltage $V_{th}$ of the drive transistor $TR_D$ from the electric potential at the first node $ND_1$. As a result, the drive transistor $TR_D$ becomes an OFF state. On the other hand, for example, when the time for the threshold voltage correcting processing is forced to be set short, the difference in electric potential between the first node $ND_1$ and the second node $ND_2$ may be larger than the threshold voltage $V_{th}$ of the drive transistor $TR_D$. As a result, the drive transistor $TR_D$ may not reach OFF state in some cases. As a result of execution of the threshold voltage correcting processing, the drive transistor $TR_D$ needs not to be necessarily become the OFF state. In the threshold voltage correcting processing process, preferably, the electric potential is selected and decided so as to fulfill Expression (3), thereby preventing the light emitting portion ELP from emitting the light.

$$(V_{ofs}-V_{th})<(V_{thEL}+V_{cath}) \tag{3}$$

[Video Signal Writing Processing Process]

The video signal $V_{sig}$ is applied from the video signal line DTL to the first node $ND_1$ through the write transistor $TR_W$ which has been turned ON in accordance with the write drive pulse WS supplied from the write scanning line WSL, thereby causing the electric potential at the first node $ND_1$ to rise up to $V_{sig}$. The electric charges generated based on an electric potential change at the first node $ND_1$ ($\Delta V_{ini}=V_{sig}-V_{ofs}$) are allocated to the hold capacitor $C_{CS}$, the parasitic capacitance $C_{el}$ of the light emitting portion ELP, and the parasitic capacitance of the drive transistor $TR_D$ (such as a gate-to-source capacitance $C_{gs}$). When the electrostatic capacitance $C_{el}$ is a sufficiently larger value than that of each of the electrostatic capacitance $C_{CS}$ and the electrostatic capacitance $C_{gs}$ of the gate-to-source capacitance $C_{gs}$, the change in the electric potential at the second node $ND_2$ based on the electric potential change ($V_{sig}-V_{ofs}$) is small. In general, the electrostatic capacitance $C_{el}$ of the parasitic capacitance $C_{el}$ of the light emitting portion ELP is larger than each of the electrostatic capacitance $C_{CS}$ of the hold capacitor $C_{CS}$, and the electrostatic capacitance $C_{gs}$ of the gate-to-source capacitance $C_{gs}$. In view of this point, except for cases where there is a special necessity, the change in the electric potential at the second node $ND_2$ caused by the change in the electric potential at the first node $ND_1$ is not taken into consideration. In this case, the gate-to-source voltage $V_{gs}$ can be expressed by Expression (4):

$$V_g=V_{sig}$$

$$V_s\approx V_{ofs}-V_{th}$$

$$V_{gs}\approx V_{sig}-(V_{ofs}-V_{th}) \tag{4}$$

[Mobility Correcting Processing Process]

A current is supplied to the hold capacitor $C_{CS}$ through the drive capacitor $TR_D$ while the video signal $V_{sig}$ is supplied to one terminal of the hold capacitor $C_{CS}$ through the write transistor $TR_W$ (i.e., the drive voltage corresponding to the video signal $V_{sig}$ is written to the hold capacitor $C_{CS}$). For example, in a state in which the video signal $V_{sig}$ is supplied from the video signal line DTL to the first node $ND_1$ through the write transistor $TR_W$ which has been turned ON in accordance with the write drive pulse WS supplied from the write scanning line WSL, power is supplied to the drive transistor $TR_D$ to cause the drain current $I_{ds}$ to flow, thereby changing the electric potential at the second node $ND_2$. Then, after a lapse of a predetermined period of time, the write transistor $TR_W$ is turned OFF. Let ΔV (=an electric potential correction value, or an amount of negative feedback) be a change in the electric potential at the second node $ND_2$ at this time. A predetermined period of time for execution of the mobility correcting processing can be previously decided as a design value during designing of the display device. It is noted that in this case, preferably, a mobility correction period of time is determined so as to fulfill Expression (5). By adopting such a process, the light emitting portion ELP is prevented from emitting light for the mobility correction period of time.

$$(V_{ofs}-V_{th}+\Delta V)<(V_{thEL}+V_{cath}) \quad (5)$$

When a value of the mobility μ of the drive transistor $TR_D$ is large, the electric potential correction value ΔV becomes large. On the other hand, when the value of the mobility μ of the drive transistor $TR_D$ is small, the electric potential correction value ΔV becomes small. The gate-to-source voltage $V_{gs}$ of the drive transistor $TR_D$ (i.e., the difference in electric potential between the first node $ND_1$ and the second node $ND_2$) at this time can be expressed by Expression (6):

$$V_{gs}\approx V_{sig}-(V_{ofs}-V_{th})-\Delta V \quad (6)$$

The gate-to-source voltage $V_{gs}$ defines the luminance in during light emission. The electric potential correction value ΔV is proportional to the drain current $I_{ds}$ of the drive transistor $TR_D$, and also the drain current $I_{ds}$ is proportional to the mobility μ of the drive transistor $TR_D$. As a result, since the electric potential correction value ΔV becomes larger as the mobility μ is larger, it is possible to remove the dispersion of the mobility μ among the pixel circuits 10.

[Light Emission Process]

The write transistor $TR_W$ is turned OFF in accordance with the write drive pulse WS supplied from the write scanning line WSL to cause the first node $ND_1$ to become a floating state. In this floating state, the electric power is supplied from the power source to the drive transistor $TR_D$ to cause the drain current $I_{ds}$ corresponding to the gate-to-source voltage $V_{gs}$ (the difference in electric potential between the first node $ND_1$ and the second node $ND_2$) of the drive transistor $TR_D$ to flow through the light emitting portion ELP through the drive transistor $TR_D$, whereby the light emitting portion ELP is driven to emit light.

[Different Points Due to Configuration of Drive Circuit]

Here, different points among the typical 5Tr/1C type drive configuration, 4Tr/1C type drive configuration, 3Tr/1C type drive configuration, and 2Tr/1C type drive configuration are as follows. In the case of the 5Tr/1C type drive configuration, a first transistor $TR_1$ (light emission control transistor), a second transistor $TR_2$, and a third transistor $TR_3$ are provided. The first transistor $TR_1$ is connected between the main electrode terminal of the drive transistor $TR_D$ on the power source side and the power source circuit (power source portion). The second transistor TR2 applies the second node initialization voltage. The third transistor $TR_3$ applies the first node initialization voltage. Each of the first transistor $TR_1$, the second transistor $TR_2$, and the third transistor $TR_3$ is a switching transistor. The first transistor $TR_1$ is held in the ON state for the light emission period of time, and is then turned OFF to enter the non-light emission period of time. After that, the first transistor $TR_1$ is turned ON once during the subsequent threshold voltage correction period of time, and is also held in the ON state in and after the mobility correction period of time (during the next light emission period of time as well). The second transistor $TR_2$ is held in the ON sate only for the second node initialization period of time, and is held in the OFF state for any of periods of time other than the second node initialization period of time. The third transistor $TR_3$ is held in the ON state only for the period of time from the first node initialization period of time to the threshold voltage correction period of time, and is held in the OFF state for any of the periods of time other than that period of time. The write transistor $TR_W$ is held in the ON state for the period of time from a video signal writing processing period of time to the mobility correcting processing period of time, and is held in the OFF state for any of the periods of time other than that period of time.

In the case of the 4Tr/1C type drive configuration, the third transistor $TR_3$ which supplies the first node initialization voltage is removed from the 5Tr/1C type drive configuration. Also, the first node initialization voltage is supplied with the video signal $V_{sig}$ from the video signal line DTL in a time division manner. The write transistor $TR_W$ is held in the ON state for the first node initialization period of time as well in order to supply the first node initialization voltage from the video signal line DTL to the first node for the first node initialization period of time. Typically, the write transistor $TR_W$ is held in the ON state for the period of time from the first node initialization period of time to the mobility correcting processing period of time, and is held in the OFF state for any of the periods of time other than that period of time.

In the case of the 3Tr/1C type drive configuration, both of the second transistor $TR_2$, and the third transistor TR3 are removed from the 5TR/1C type drive configuration. Also, the first node initialization voltage and the second node initialization voltage are supplied with the video signal $V_{sig}$ from the video signal line DTL in a time division manner. For the electric potential of the video signal DTL, in order that the electric potential at the second node $ND_2$ may be set to the second node initialization voltage for the second node initialization period of time, and the electric potential at the first node $ND_1$ may be set to the first node initialization voltage for the subsequent first node initialization period of time, a voltage $V_{ofs_H}$ corresponding to the second node initialization voltage is supplied and a first node initialization voltage $V_{ofs_L}$ (=$V_{ofs}$) is then obtained. Also, due to this, the write transistor $TR_W$ is held in the ON state for both of the first node initialization period of time and the second node initialization period of time as well. Typically, the write transistor $TR_W$ is held in the ON state for the period of time from the second node initialization period of time to the mobility correcting processing period of time, and is held in the OFF state for any of the periods of time other than that period of time.

Incidentally, in the case of the 3Tr/1C type drive configuration, the electric potential at the second node $ND_2$ is changed by utilizing the video signal line DTL. For this reason, the electrostatic capacitance $C_{CS}$ of the hold capacitor $C_{CS}$ is set to a larger value than that of the other types of drive circuit (for example, the electrostatic capacitance $C_{CS}$ is set to about ¼ to ⅓ of the electrostatic capacitance $C_{el}$) in terms of the design. Therefore, the point that the degree of the change in the electric potential at the second node $ND_2$ caused by the change in the electric potential at the first node $ND_1$ is large is taken into consideration.

In the case of the 2Tr/1C type drive configuration, the first transistor $TR_1$, the second transistor $TR_2$, and the third transistor $TR_3$ are all removed from the 5TR/1C type drive configuration. Also, the first node initialization voltage is supplied with the video signal $V_{sig}$ from the video signal line DTL in a time division manner. Also, the main electrode terminal of the drive transistor $TR_D$ on the power source side is pulse-driven by using both of the first electric potential $V_{cc_H}$ (=$V_{cc}$ in the case of the 5Tr/1C type drive configuration) and the second electric potential $V_{cc_L}$ (=$V_{ini}$ in the case of the 5Tr/1C type drive configuration), thereby giving the second node initialization voltage. The electric potential at the main electrode terminal of the drive transistor $TR_D$ on the power source side is set to the first electric potential $V_{cc_H}$ for the light emission period of time, and is then set to the second electric potential $V_{cc_L}$, so that the light emitting portion ELP enters the non-light emission period of time. Also, the electric potential at the main electrode terminal of the drive transistor $TR_D$ on the power source side is set to the first electric potential $V_{cc_H}$ in and after the subsequent threshold correction period of time (for the next light emission period of time as well). The write transistor $TR_W$ is held in the ON state for the first node initialization period of time as well in order to supply the first node initialization voltage from the video signal line DTL to the first node $ND_1$ for the first node initialization period of time. Typically, the write transistor $TR_W$ is held in the ON state for the period of time from the first node initialization period of time to the mobility correcting processing period of time, and is held in the OFF state for any of the periods of time other than that period of time.

It is noted that although the description has been given here of cases where the correction processing is executed for, as dispersion of the characteristics of the drive transistors, both of the threshold voltage and the mobility, the correction processing may alternatively be executed for only one of the threshold voltage and the mobility.

In the third embodiment of the present disclosure, it is suppressed that the electrooptic element (organic EL element) is turned ON during the processing for supplying the current to the hold capacitor $C_{CS}$ through the drive transistor $TR_D$ while the drive voltage corresponding to the video signal $V_{sig}$ which will be described later is written to the hold capacitor $C_{CS}$. Thus, there is provided the effect that the operation of the pixel circuit is controlled in such a way the electrooptic element is prevented from being turned ON for the first processing period of time.

3. ELECTRONIC APPARATUS (FOURTH EMBODIMENT)

An electronic apparatus according to a fourth embodiment of the present disclosure includes the pixel array portion 102, the signal generating portion, and the control portion. In this case, the light emitting elements (pixel circuit) 10 each including the electrooptic element (organic EL element), the hold capacitor $C_{CD}$, the write transistor $TR_W$ for writing the drive voltage corresponding to the video signal $V_{sig}$ supplied to one of the main electrode terminals thereof, and the drive transistor $TR_D$ for driving the electrooptic element in accordance with the drive voltage written to the hold capacitor $C_{CS}$, the control input terminal of the drive transistor $TR_D$ being connected to one terminal of the hold capacitor $C_{CS}$ at the first node are disposed in the pixel array portion 102. Also, one of main electrode terminals of the drive transistor $TR_D$, the other terminal of the hold capacitor $C_{CS}$, and one terminal of the electrooptic element are electrically connected to the second node in the pixel array portion 102. Also, the signal generating portion generates the video signal supplied to the pixel portion. In addition thereto, the control portion suppresses that the electrooptic element is turned ON in conjunction with the first processing for supplying the current to the hold capacitor $C_{CS}$ through the drive transistor $TR_D$ while the drive voltage corresponding to the video signal $V_{sig}$ is written to the hold capacitor $C_{CS}$ through the write transistor $TR_W$. Thus, there is provided the effect that the operation of the pixel circuit is controlled in such a way the electrooptic element is prevented from being turned ON for the first processing period of time.

Although the present disclosure has been described so far based on the preferred embodiments, the present disclosure is by no means limited to the preferred embodiments. The various kinds of configurations and structures composing the display device, the display element (pixel circuit), the method of driving the pixel circuit, and the electronic apparatus which have been described in the embodiments, and the processes in the method of driving the pixel circuit are all merely exemplified, and thus can be suitably changed.

In addition, regarding the operation of the 5Tr/1C type drive configuration, the 4Tr/1C type drive configuration, and the 3Tr/1C type drive configuration, the writing processing and the mobility correcting processing may be separately executed, or the mobility correcting processing may be executed together with the writing processing. Specifically, it is only necessary that in a state in which the first transistor $TR_1$ (light emission control transistor) is held in the ON state, the video signal $V_{sig}$ is applied from the data line DTL to the first node ND1 through the write transistor $TR_W$.

4. CONCRETE EXAMPLES

Hereinafter, a description will be given of the Concrete Examples incorporating the technique of suppressing the display nonuniformity phenomenon due to turn ON of the electrooptic element. It is noted that in a display device using the active matrix type organic EL panel, for example, the various kinds of gate signals (control pulses) which are to be supplied to the control input terminals of the transistors by the vertical scanning portion disposed either on both sides of the panel or on one side of the panel are generated, and are then applied to the pixel circuits 10. In addition thereto, in the display device using such an organic EL panel, for reduction of the number of elements and high definition promotion, the 2Tr/1C type pixel circuit 10 is used in some cases. In view of this point, in the following description, Concrete Examples where the technique is applied to the 2Tr/1C type drive configuration will be described.

4-1. Example 1

Pixel Circuit

Figure 4:
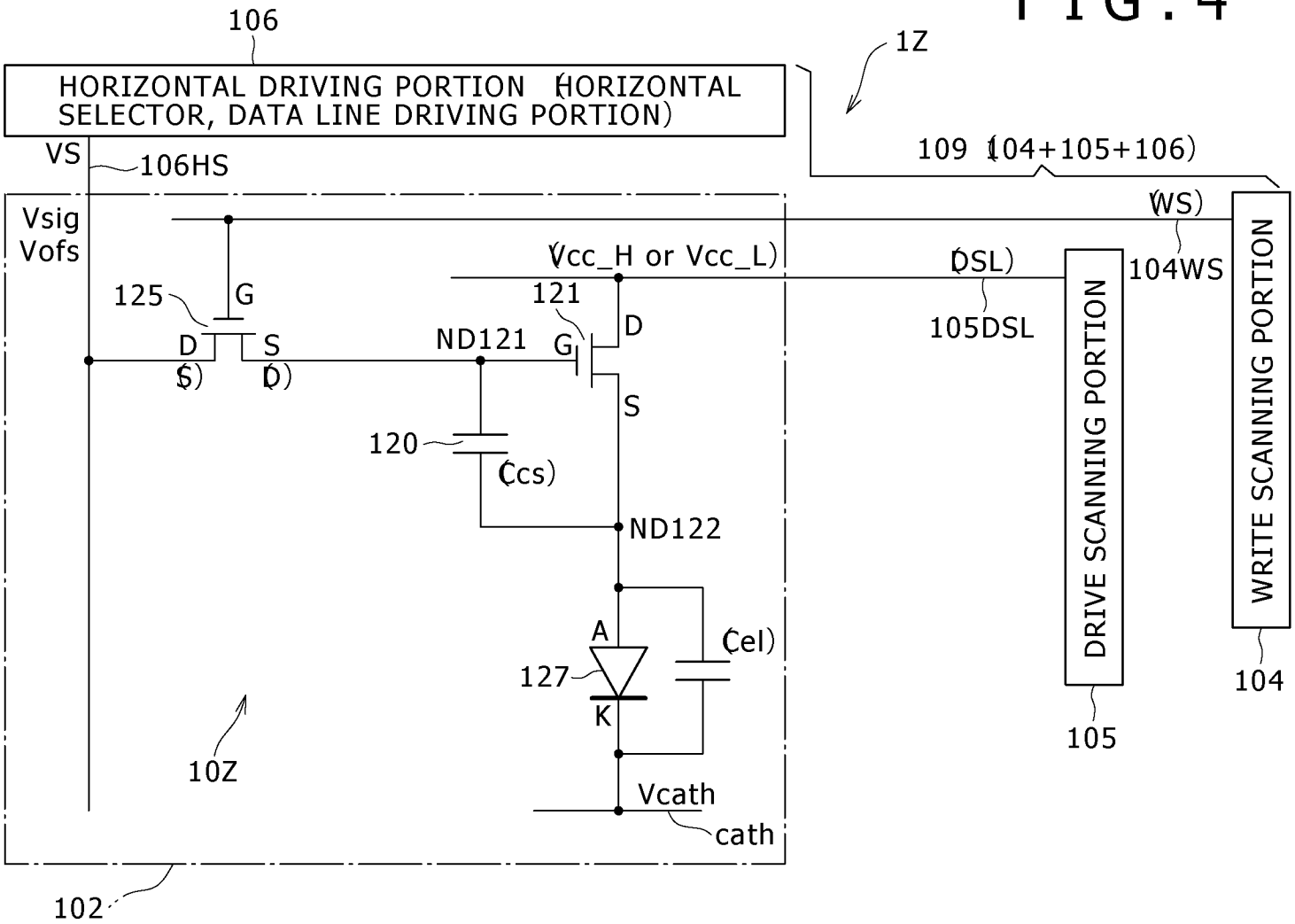
FIG. 4 is a circuit diagram, partly in block, showing a configuration of one form of a pixel circuit in a display device according to Comparative Example of Example 1 of the first embodiment of the present disclosure.
Figure 5:
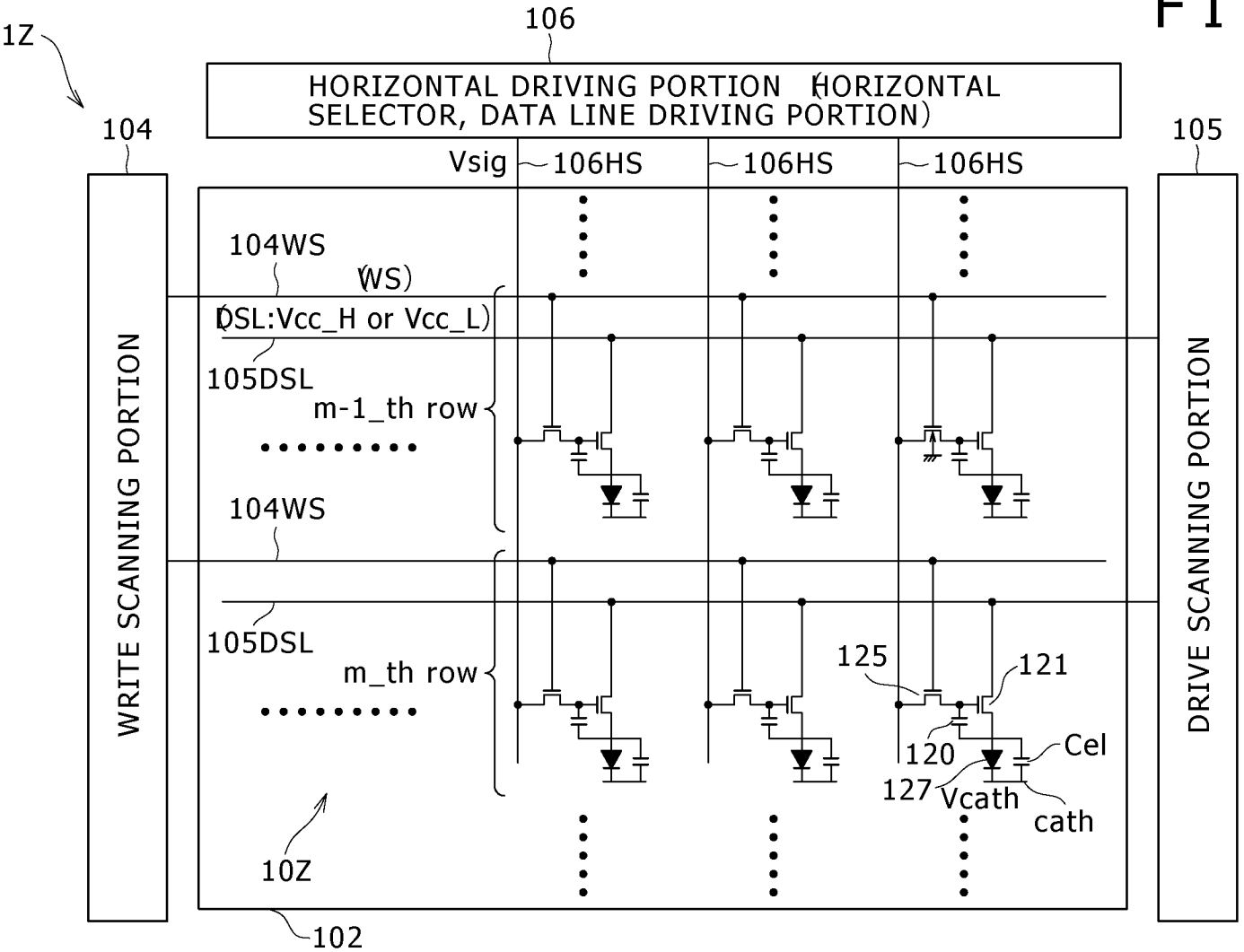
FIG. 5 is a circuit diagram, partly in block, showing a configuration of an entire outline of the display device including the pixel circuit of Comparative Example shown in FIG. 4.
Figure 6:
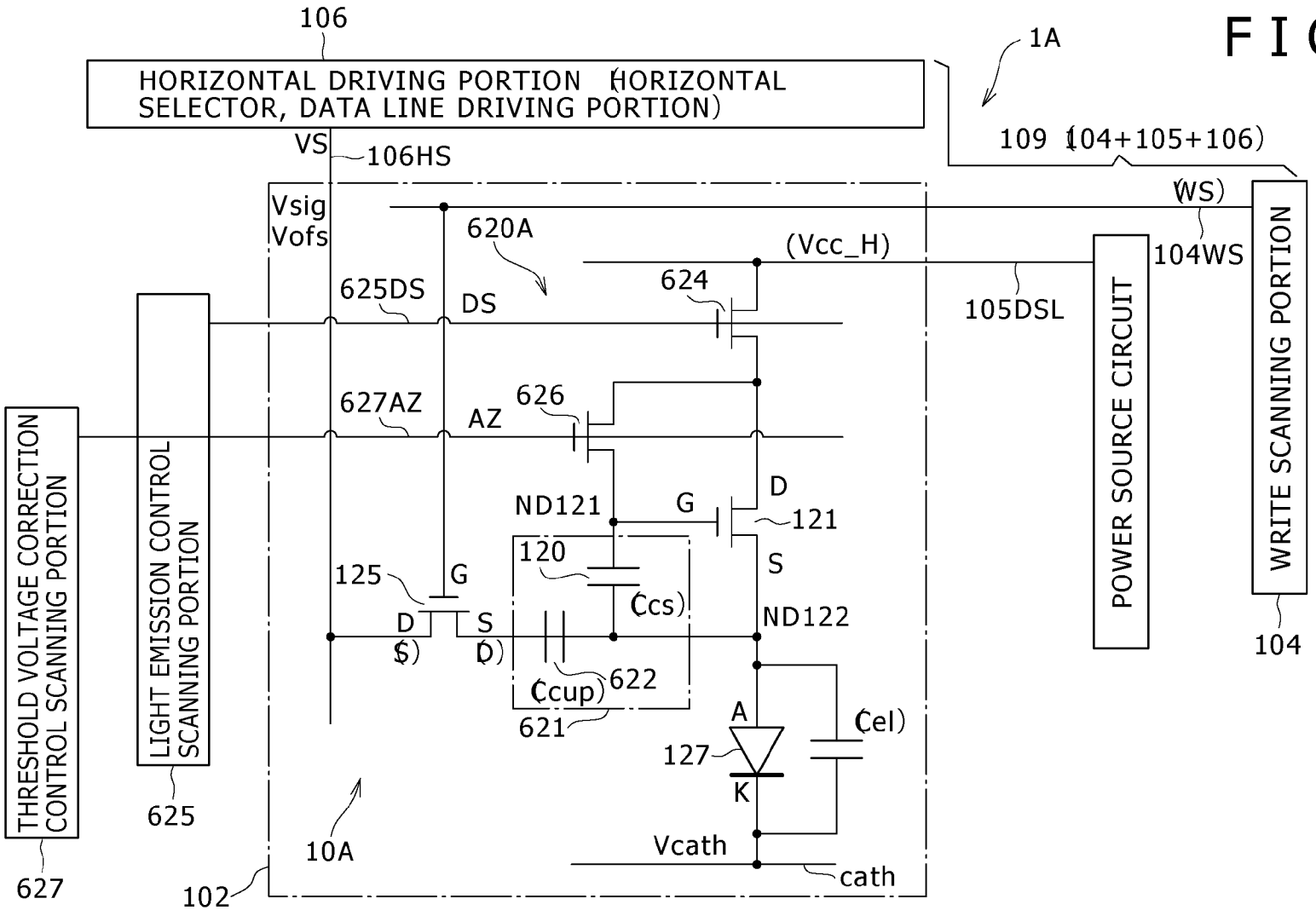
FIG. 6 is a circuit diagram, partly in block, showing a configuration of one form of a pixel circuit in a display device according to Example 1 of the first embodiment of the present disclosure.
Figure 7:
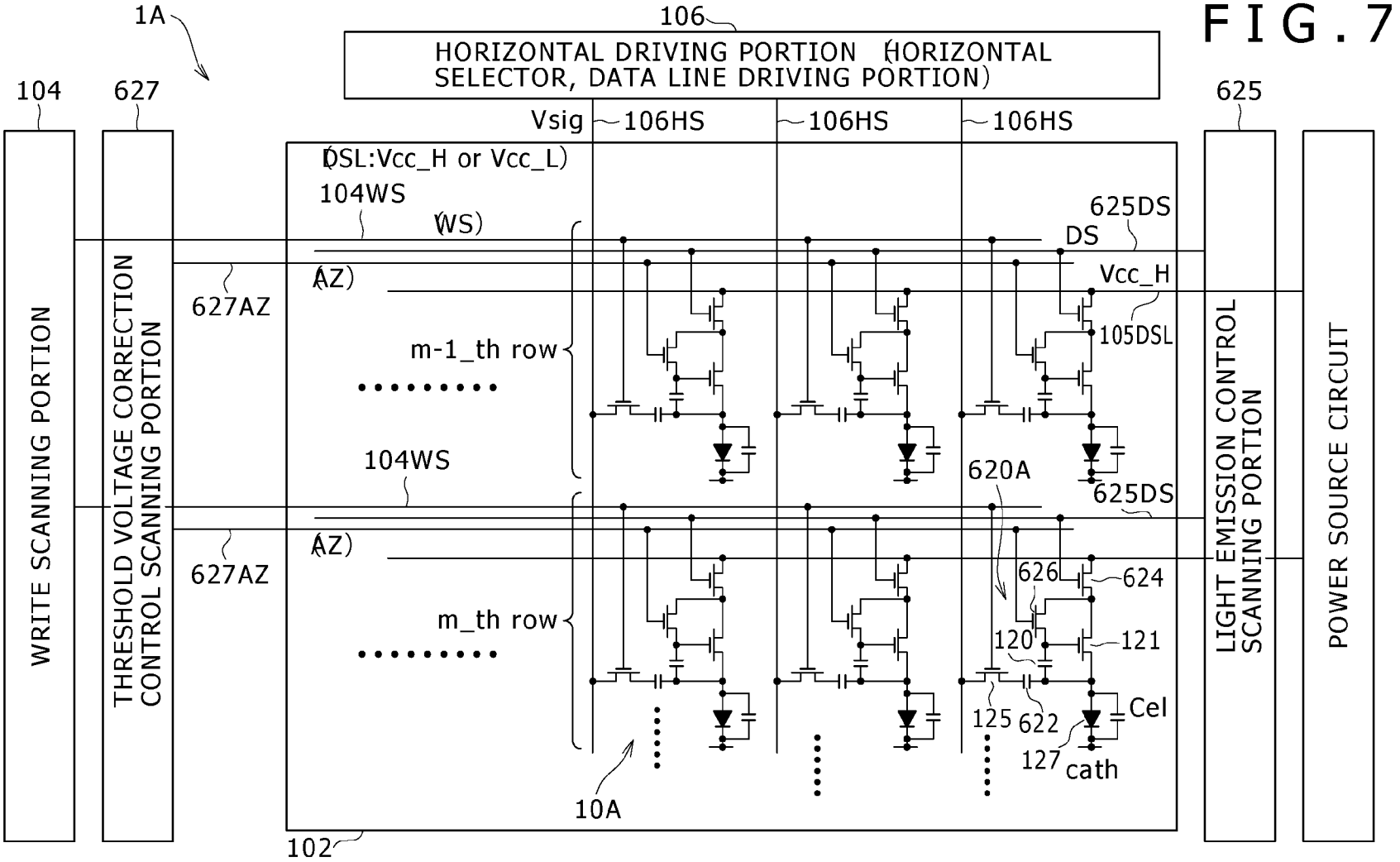
FIG. 7 is a circuit diagram, partly in block, showing a configuration of an entire outline of the display device, including the pixel circuit, according to Example 1 of the first embodiment of the present disclosure.

FIGS. 4 and 5 show a pixel circuit 10Z and one form of a display device including the pixel circuit 10Z of Comparative Example for Examples according to the technique of this disclosure. The display device including the pixel circuit 10Z of Comparative Example in the pixel array portion 102 is referred to as a display device 1Z. FIG. 4 shows a basic configuration (for one pixel), and FIG. 5 shows a concrete configuration (of the entire display device). FIGS. 6 and 7 are respectively diagrams showing one form of a pixel circuit 10A of Example 1, and a display device including the pixel circuit 10A. The display device including the pixel circuit 10A of Example 1 in the pixel array portion 102 is referred to as a display device 1A of Example 1. FIG. 6 shows a basic configuration (for one pixel), and FIG. 7 shows a concrete configuration (of the entire display device). Incidentally, in either of Comparative Example and Example 1, both of the vertical driving portion 103 and the horizontal driving portion 106 are shown together with other constituent portions on the substrate 101 of the display panel portion 100. This also applies to each of Examples which will be described later.

Firstly, portions common to Comparative Example and Example 1 will be described with reference symbols A and Z being omitted. In the display device 1, an electrooptic element (an organic EL element 127 is used as the light emitting portion ELP in this case) within the pixel circuit 10 is caused to emit light in accordance with the video signal $V_{sig}$ (specifically, a signal amplitude $\Delta V_{in}$). For this reason, the display device 1 includes at least a drive transistor 121 (the drive transistor $TR_D$), a hold capacitor 120 (the hold capacitor $C_{CS}$), the organic EL element 127 (the light emitting portion ELP), and a sampling transistor 125 (the write transistor $TR_W$). In this case, the drive transistor 121 generates a drive current and supplies the resulting drive current to the organic EL element 127. The hold capacitor 120 is connected between a control input terminal (typically, a gate electrode terminal) and an output terminal (typically, a source electrode terminal) of the drive transistor 121. The organic EL element 127 is an example of the electrooptic element and is connected to the output terminal of the drive transistor 121. Also, the sampling transistor 125 writes information to the hold capacitor 120 according to the signal amplitude $\Delta V_{in}$. In the pixel circuit 10, the drive current $I_{ds}$ based on the information held in the hold capacitor 120 is generated by the drive transistor 121 to be caused to flow through the organic EL element 127 as the example of the electrooptic element, thereby causing the organic EL element 127 to emit light.

Since the sampling transistor 125 writes the information on the signal amplitude $\Delta V_{in}$ to the hold capacitor 120, the sampling transistor 125 fetches a signal electric potential ($V_{ofs}+\Delta V_{in}$) in an input terminal thereof (either one of a source electrode terminal or drain electrode terminal thereof), and writes the information on the signal amplitude $\Delta V_{in}$ to the hold capacitor 120 connected to an output terminal (the other of the source electrode terminal or drain electrode terminal thereof). It is not to mention that the output terminal of the sampling transistor 125 is connected to the control input terminal of the drive transistor 121 as well.

Note that, the connection configuration of the pixel circuit 10 shown here is the most basic configuration. Thus, it suffices so long as the pixel circuit 10 is one including at least the constituent elements described above, and the pixel circuit 10 may include constituent elements other than those constituent elements (i.e., other constituent elements). In addition, the wording "connection" is not limited to direct connection, but may also refer to a connection made through other constituent element(s). For example, an alteration such as interposition of a switching transistor or a functional portion having a certain function may be made in some cases as may be necessary. Even in the case of the pixel circuits of such modified changes, any of such modification realizes the display device according to the first embodiment of the present disclosure as long as it can realize the constitution and operation which will be described in Example 1 (or any other suitable Example).

In addition, for example, a control portion 109 including a write scanning portion 104 and a drive scanning portion 105 is provided in the peripheral portion for driving the pixel circuit 10. In this case, the write scanning portion 104 scans the pixel circuits 10 line-by-line by sequentially controlling the sampling transistors 125 in a horizontal cycle, so as to write the information on the signal amplitude $\Delta V_{in}$ of the video signal $V_{sig}$ to the hold capacitors 120 for one row. Meanwhile, in accordance with this line-sequential scanning by the write scanning portion 104, the drive scanning portion 105 outputs a scanning drive pulse (power source drive pulse DSL) to control the supply of power applied to the power source supply terminals of the drive transistors 121 of the one row. The control portion 109 also includes a horizontal driving portion 106. The horizontal driving portion 106 carries out control in such a way that the video signal $V_{sig}$ switches between the reference electric potential ($V_{ofs}$) and the signal electric potential ($V_{ofs}+\Delta V_{in}$) in each horizontal cycle, in accordance with the line-sequential scanning by the write scanning portion 104.

Preferably, the control portion 109 performs control so as to carry out bootstrap operation. The bootstrap operation in this case means such operation that, at the time the information on the signal amplitude $\Delta V_{in}$ is written to the hold capacitor 120, the sampling transistor 125 is turned into a non-conduction state to stop the supply of video signal $V_{sig}$ to the control input terminal of the drive transistor 121, thereby changing the electric potential at the control input terminal in conjunction with the change in the electric potential at the output terminal of the drive transistor 121. Preferably, the control portion 109 carries out the bootstrap operation also at an initial stage of a start of light emission after completion of sampling operation. That is to say, after the sampling transistor 125 has been turned into a conduction state while the signal electric potential ($V_{ofs}+\Delta V_{in}$) is being supplied to the sampling transistor 125, the sampling transistor 125 is caused to become a non-conduction state, so that the electric potential deference between the control input terminal and the output terminal of the drive transistor 121 is maintained constant.

In addition, preferably, the control portion 109 controls the bootstrap operation in such a way that the correcting operation for temporal change of the electrooptic element (the organic EL element 127) is realized in the light emission period of time. To achieve this, the control portion 109 may continuously hold the sampling transistor 125 in a non-conduction state during the period of time the drive current $I_{ds}$ based on the information held in the hold capacitor 120 is flowing through the electrooptic element (the organic EL element 127). The difference in electric potential between the control input terminal and the output terminal of the drive transistor 121 can then be maintained constant, thereby realizing the correcting operation for the temporal change of the electric element. Even when current-voltage characteristics of the organic EL element 127 is changed with time, the bootstrap operation of the hold capacitor 120 for light emission allows the emission luminance to be constantly steady as the voltage difference in electric potential between the control input terminal and the output terminal of the drive transistor 121 is held constant by the hold capacitor 120. In addition, preferably, the control portion 109 carries out control in such a way that, in a time zone where the reference electric potential (=the first node initialization voltage $V_{ofs}$) is supplied to the input terminal (typically, the source electrode terminal) of the sampling transistor 125, the sampling transistor 125 is caused to be in a conduction state so as to carry out threshold voltage correcting operation for causing the hold capacitor 120 to hold a voltage corresponding to the threshold voltage $V_{th}$ of the drive transistor 121.

The threshold voltage correcting operation may be repetitively carried out for a plurality of horizontal cycles preceding the writing operation of the information on the signal amplitude $\Delta V_{in}$ to the hold capacitor 120, as necessary. Here, the wording "as necessary" means a case where the hold capacitor 120 cannot sufficiently hold the voltage corresponding to the threshold voltage of the drive transistor 121 within the threshold voltage correction period of time in one horizontal cycle. The threshold voltage correcting operation is carried out for a plurality of times, whereby the voltage corresponding to the threshold voltage $V_{th}$ of the drive transistor 121 is reliably held in the hold capacitor 120.

In addition, more preferably, the control portion 109 carries out control in such a way that, in a time zone in which the reference electric potential ($V_{ofs}$) is supplied to the input terminal of the sampling transistor 125, the sampling transistor 125 is caused to be in a conduction state prior to the threshold correcting operation, thereby carrying out preparation operations (such as discharging operation and initialization operation) for the threshold voltage correction. The electric potentials at the control input terminal and the output terminal of the drive transistor 121 are initialized before the threshold voltage correction is carried out. More specifically, the difference in electric potential between the terminals of the hold capacitor 120 is set to become equal to or larger than the threshold voltage $V_{th}$ by connecting the hold capacitor 120 between the control input terminal and output terminal of the drive transistor 121.

Incidentally, as for threshold voltage correction in the 2TR/1C type drive configuration, the control portion 109 may be provided with a drive scanning portion 105 that outputs potential to each of the pixel circuits 10 in one row in such a manner that it switches the potential between a first electric potential $V_{cc_H}$ used to cause the drive current $I_{ds}$ through the electrooptic element (the organic EL element 127), and a second electric potential $V_{cc_L}$ different from the first electric potential $V_{cc_i}$, in accordance with the line-sequential scanning by the write scanning portion 104. The drive scanning portion 105 can carry out the threshold voltage correcting operation by performing control in such a way that the sampling transistor 125 is caused to be in a conduction state in a time zone in which a voltage corresponding to the first electric potential $V_{cc_H}$ is being supplied to the power source supply terminal of the drive transistor 121 and also the signal electric potential ($V_{ofs}+\Delta V_{in}$) is being supplied to the sampling transistor 125. Further, as for preparing operation for the threshold voltage correction in the 2TR type drive configuration, the sampling transistor 125 can be caused to turn into a conduction state in a time zone in which the voltage corresponding to the second electric potential $V_{cc_H}$ (=the second node initialization voltage $V_{ini}$) is being supplied to the power source supply terminal of the drive transistor 121 and also the reference electric potential ($V_{ofs}$) is being supplied to the sampling transistor 125. In this state, the electric potential at the control input terminal (i.e., the first node $ND_1$) of the drive transistor 121 can be initialized to the reference electric potential ($V_{ofs}$), and the electric potential at the output terminal (i.e., the second node $ND_2$) can be initialized to the second electric potential $V_{cc_L}$.

More preferably, the control portion 109 carries out control in such a way that after completion of the threshold voltage correcting operation, the sampling transistor 125 is caused to be in a conduction state in a time zone for which the voltage corresponding to the first electric potential $V_{cc_H}$ is supplied to the drive transistor 121, and the signal electric potential ($V_{ofs}+\Delta V_{in}$) is supplied to the sampling transistor 125. As a result, the control portion 109 carries out control in such a way that when the information on the signal amplitude $\Delta V_{in}$ is written to the hold capacitor 120, information for the correction for the mobility μ of the drive transistor 121 is added to the information which is to be written to the hold capacitor 120. In this phase, the sampling transistor 125 may be in a conduction state for a period of time that starts at a certain time point within the time zone during which the signal electric potential ($V_{ofs}+\Delta V_{th}$) is supplied to the sampling transistor 125 and is shorter than the time zone. Next, an example of the pixel circuit 10 with the 2Tr/1C type drive configuration will be concretely described.

In the pixel circuit 10, basically, the drive transistor is an n-channel thin film field-effect transistor. A feature of the pixel circuit 10 resides in that it adopts a drive system in which the pixel circuit 10 includes a circuit for suppressing a change in the drive current $I_{ds}$ supplied to the organic EL element due to the temporal deterioration of the organic EL element, that is, a drive signal fixing circuit (a first one) for maintaining the drive current $I_{ds}$ constant by correcting a change in current-voltage characteristics of the organic EL element as an example of an electrooptic element. Another feature of the pixel circuit 10 is that it adopts a drive system in which the drive current $I_{ds}$ is maintained constant by realizing a threshold voltage correcting function and a mobility correcting function that prevent the change in the drive current $I_{ds}$ due to the change in the characteristics (such as dispersion in threshold voltage and mobility) of the drive transistor.

As a method of suppressing the influence exerted on the drive current $I_{ds}$ due to the change in the characteristics (such as dispersion and change in the threshold voltage, the mobility, and the like) of the drive transistor 121, the drive circuit of the 2Tr/1C type drive configuration is directly adopted as the drive signal fixing circuit (the first one). The drive timing for the transistors (the drive transistor 121 and the sampling transistor 125) is devised to thereby cope with the dispersion and change in the threshold voltage, the mobility, and the like. Since the pixel circuit 10 has the 2Tr/1C type drive configuration and thus the number of elements and the number of wirings are each small, promotion of high definition is possible. In addition, since sampling can be carried out without the deterioration of the video signal $V_{sig}$, it is possible to obtain excellent image quality.

In addition, the pixel circuit 10 has a feature in the connection form of the hold capacitor 120, and it includes the bootstrap circuit, which is an example of a drive signal fixing circuit (a second one), as a circuit for preventing the charge in the drive current $I_{ds}$ due to the temporal deterioration of the organic EL element 127. It is one feature of the pixel circuit 10 that it include the drive signal fixing circuit (the second one) which realizes the bootstrap function of fixing the drive current $I_{ds}$ (preventing change in the drive current $I_{ds}$) even when there is the temporal change in the current-voltage characteristics of the organic EL element.

Field-effect transistors (FETs) are used as the transistors, including the drive transistor. In this case, with regard to the drive transistor, the gate electrode terminal is treated as a control input terminal, one of its source electrode terminal and drain electrode terminal (here, the source electrode terminal) is treated as the output terminal, and the other (the drain electrode terminal in this case) is treated as the power source supply terminal.

Specifically, as shown in FIGS. 4 and 5, the pixel circuit 10 includes an n-channel drive transistor 121, an n-channel sampling transistor 125, and an organic EL element 127 as an example of an electrooptic element which emits light when a current flows therethrough. In general, since the organic EL element 127 has a rectification property, the organic EL element 127 is represented by the symbol of a diode. The organic EL element 127 has a parasitic capacitance $C_{el}$. In FIGS. 4 and 5, the parasitic capacitance $C_{el}$ is shown in parallel with the organic EL element 127 (represented by the symbol of a diode).

With regard to the drive transistor 121, a drain terminal D thereof is connected to a power supply line 105DSL through which either the first electric potential $V_{cc_H}$ or the second electric potential $V_{cc_L}$ is supplied, and a source terminal S thereof is connected to an anode terminal A of the organic EL element 127 (the connection point thereof is the second node $ND_2$ and is represented as a node ND122). A cathode terminal K of the organic EL element 127 is connected to a cathode wiring cath (the electric potential thereof is a cathode electric potential $V_{cath}$, for example, GND) through which the reference electric potential is supplied and which is common to all of the pixel circuits 10. The cathode wiring cath may be composed of only a single layer wiring (upper layer wiring) for the cathode wiring cath, or, for example, an auxiliary wiring for the cathode wiring may also be provided in the anode layer in which a wiring for the anode is formed, thereby reducing a resistance value of the cathode wiring. The auxiliary wiring is wired in a lattice-like shape, in a column-like shape or in a row-like shape within the pixel array portion 102 (display area), and has the same electric potential as that of the upper layer wiring, that is, a fixed electric potential.

With regard to the sampling transistor 125, a gate terminal G thereof is connected to a write scanning line 104WS extending from the write scanning portion 104, a drain terminal D thereof is connected to a video signal 106HS (a video signal line DTL), and a source terminal S thereof is connected to the gate terminal G of the drive transistor 121 (the connection point thereof is the first node ND1 and is represented as a node ND121). A write drive pulse WS at an active H level is supplied from the write scanning portion 104 to the gate terminal G of the sampling transistor 125. The sampling transistor 125 may adopt a connection form in which the source terminal S and the drain terminal D are reversed.

The drain terminal D of the drive transistor 121 is connected to the power supply line 105DSL extending from the drive scanning portion 105 functioning as a power scanner. The feature of the power supply line 105DSL resides in that the power supply line 105DSL itself has an ability to supply electric power from the power source to the drive transistor 121. The drive scanning portion 105 supplies potential to the drain terminal D of the drive transistor 121 in such a manner that it switches the potential between the first electric potential $V_{cc_H}$ which is the higher voltage that corresponds to the power source voltage, and the second electric potential $V_{cc_L}$ (referred to as either an initialization voltage or an initial voltage as well), which is the lower voltage that is utilized for the preparation operation preceding the threshold correction and corresponds to the power source voltage.

The drain terminal D side (power source circuit side) of the drive transistor 121 is driven by using the power source drive pulse DSL taking two values of the first electric potential $V_{cc_H}$ and the second electric potential $V_{cc_L}$, thereby making it possible to carry out the preparation operation preceding the threshold correction. The second electric potential $V_{cc_L}$ is set to an electric potential sufficiently lower than the reference electric potential ($V_{ofs}$) of the video signal $V_{sig}$. Specifically, the second electric potential $V_{cc_L}$ on the low electric potential side of the power supply line 105DSL is set so that a gate-to-source voltage $V_{gs}$ (the difference between a gate electric potential $V_g$ and a source electrode potential $V_s$) of the drive transistor 121 becomes larger than the threshold voltage $V_{th}$ of the drive transistor 121. It is noted that the reference electric potential ($V_{ofs}$) is not only utilized for the initialization operation preceding the threshold correcting operation, but also utilized for pre-charging the video signal line 106HS.

In such a pixel circuit 10, when the organic EL element 127 is driven, the first electric potential $V_{cc_H}$ is supplied to the drain terminal D of the drive transistor 121, and the source terminal S of the drive transistor 121 is connected to the anode terminal A side of the organic EL element 127, thereby forming a source follower circuit as a whole.

When such a pixel circuit 10 is adopted, the 2TR type drive configuration is employed in which in addition to the drain transistor 121, one switching transistor (the sampling transistor 125) is used for the scanning. By setting the ON/OFF timing of the power source drive pulse DSL and the write drive pulse WS, in accordance with which the switching transistors are controlled, the influence exerted on the drive current $I_{ds}$ due to the temporal change of the organic EL element 127, and the change in characteristics of the drive transistor 121 (such as dispersion and change in the threshold voltage and mobility) is prevented.

[Configuration Peculiar to Example 1]

Here, the pixel circuit 10A in the display device 1A of Example 1 includes the transistor characteristics correction controlling portion 620A for suppressing turn ON of the display portion during the processing for writing the drive voltage corresponding to the video signal to the hold capacitor 120. The transistor characteristics correction controlling portion 620A of Example 1 includes a capacitor portion 621, a light emission control transistor 624, the threshold voltage correction control transistor 626, the light emission control scanning portion 625, and the threshold voltage correction control scanning portion 627. The capacitor portion 621 is composed of the hold capacitor 120 and the coupling capacitor 622. The electrostatic capacitance $C_{cup}$ of the coupling capacitor 622 may have a value approximately equal to the electrostatic capacitance $C_{CS}$ of the hold capacitor 120. The drive scanning portion 105 in the pixel circuit 10Z in the display device 1Z of Comparison Example is replaced with a power source circuit, and a constant power voltage (equal to the first electric potential $V_{cc_H}$ in this case) is supplied to the power supply line 105DSL instead of a pulse-like voltage.

That is to say, in the pixel circuit 10Z of Comparative Example, one of the main electrode terminals of the sampling transistor 125 and the node ND122 (the second node $ND_2$) are directly connected to each other, whereas in the pixel circuit 10A of Example 1, the main electrode terminal of the sampling transistor 125, and the node ND122 are connected to each other through the coupling capacitor 622. Another difference between the pixel circuit 10A of Example 1 and the pixel circuit 10Z of Comparative Example is that, in the pixel circuit 10Z of Comparative Example, the main electrode terminal (on the power source side) of the drive transistor 121 is directly connected to the power supply line 105DSL, whereas the pixel circuit 10A of Example 1 includes the light emission control transistor 624 between the main electrode terminal (on the power source side) of the drive transistor 121 and the power supply line 105DSL. In addition thereto, the pixel circuit 10A of Example 1 is also different from the pixel circuit 10Z of Comparative Example in that the pixel circuit 10A of Example 1 includes the threshold voltage correction control transistor 626 between the connection point between the main electrode terminal of the drive transistor 121 and the main electrode terminal of the light emission control transistor 624, and the control input terminal (i.e., the node ND121) of the drive transistor 121. The display device 1A includes the light emission control scanning portion 625 and the threshold voltage correction scanning portion 627 outside the pixel array portion 102. The control input terminal (gate terminal) of the light emission control transistor 624 is connected to the light emission control scanning portion 625 through the light emission control line 625DS, and a light emission pulse DS at the active H level is supplied row-by-row. The control input terminal (gate terminal) of the threshold voltage correction control transistor 626 is connected to the threshold voltage correction scanning portion 627 through a threshold voltage correction control line 627AZ, and a threshold voltage correction control pulse AZ at the active H level is supplied row-by-row.

In the configuration of Example 1, the reference electric potential ($V_{ofs}$) and the video signal $V_{sig}$ (the signal electric potential: $V_{ofs}+\Delta V_{in}$) are supplied to the node ND122 through the coupling capacitor 622. In Example 1, the threshold voltage correction, the signal write, and the mobility correction are carried out by utilizing an effect of such configuration. Although details of the significations and advantages of the pixel circuit 10A of Example 1 will be described later, in particular, in the phase of writing in a signal, a signal $V_{sig}$ at a minus electric potential is written in so that the organic EL element 127 will be in a largely reverse biased state in the following mobility correction phase. Thus, the organic EL element 127 can be prevented from being turned ON during the mobility correction. As the organic EL element 127 is prevented from being turned ON during the mobility correction, it is possible to carry out the mobility correcting operation normally.

[Operation of Pixel Circuit]

Figure 8:
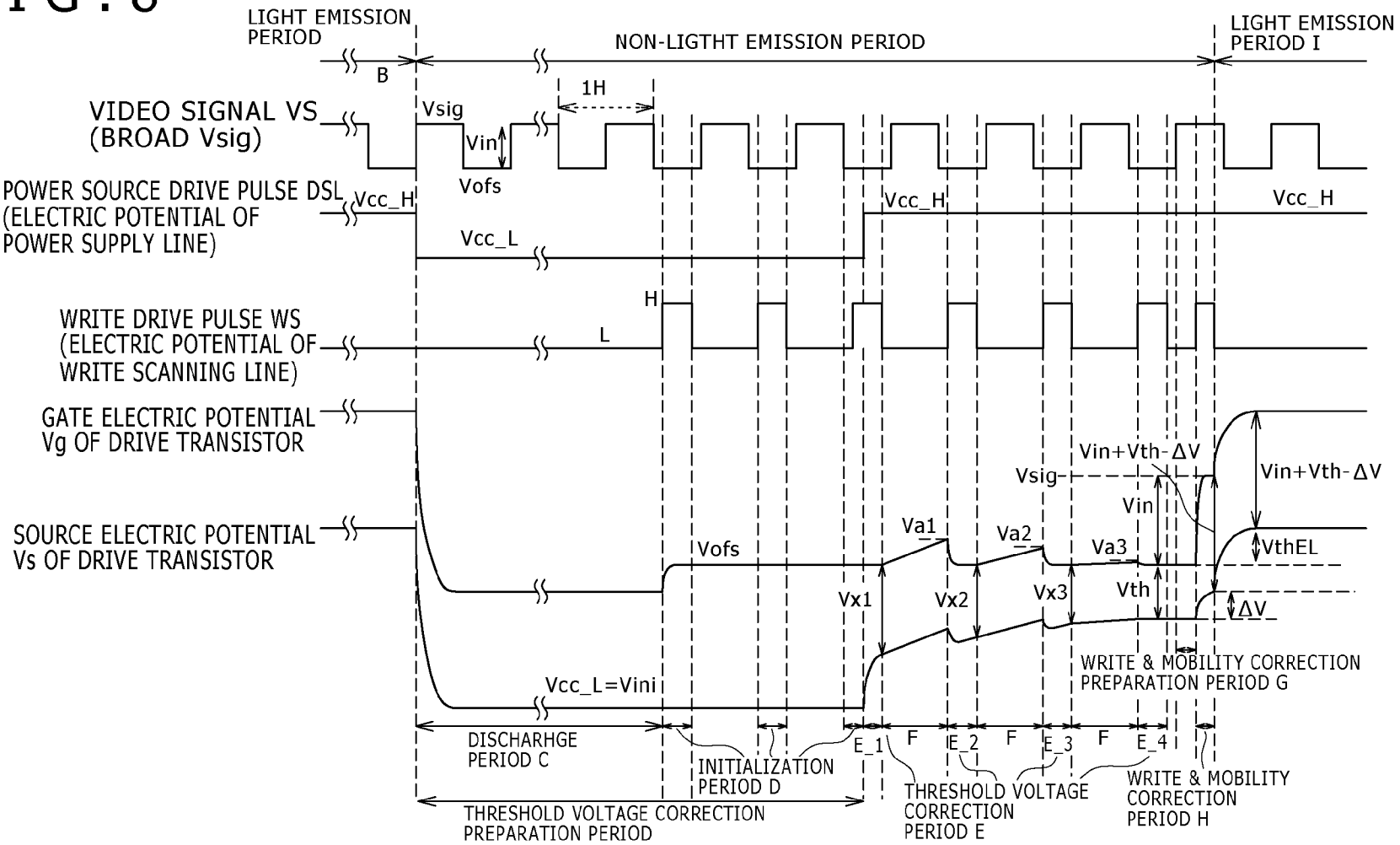
FIG. 8 is a timing chart explaining a method of driving the pixel circuit of the display device according to Comparative Example for Example 1 of the first embodiment of the present disclosure.
Figure 9A:
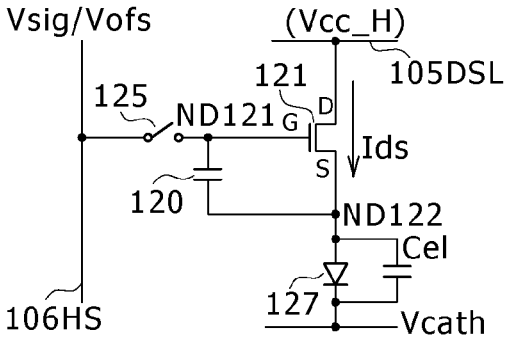
FIGS. 9A to 9G are respectively circuit diagrams explaining equivalent circuits and operation states thereof in main periods of time of the timing chart shown in FIG. 8.
Figure 9B:
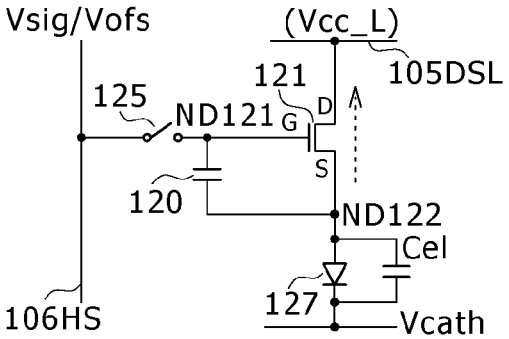
Figure 9C:
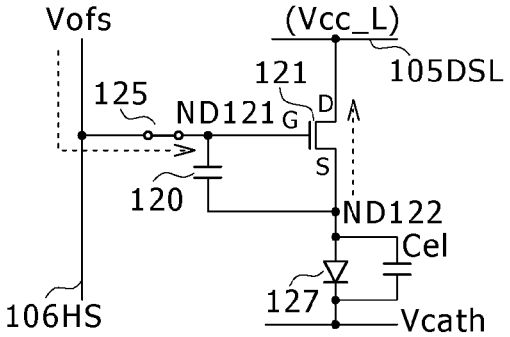
Figure 9D:
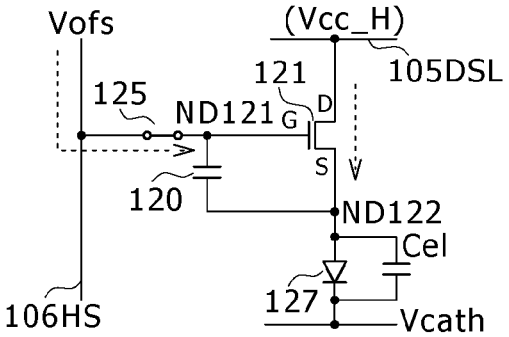
Figure 9E:
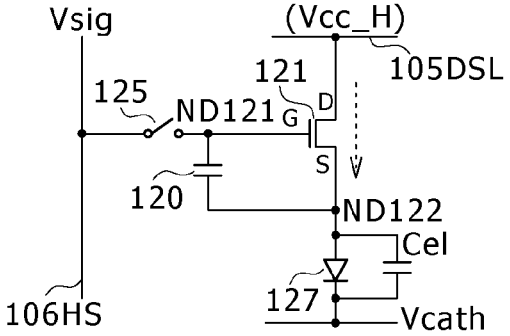
Figure 9F:
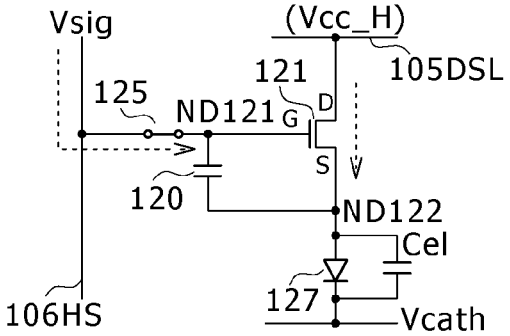
Figure 9G:
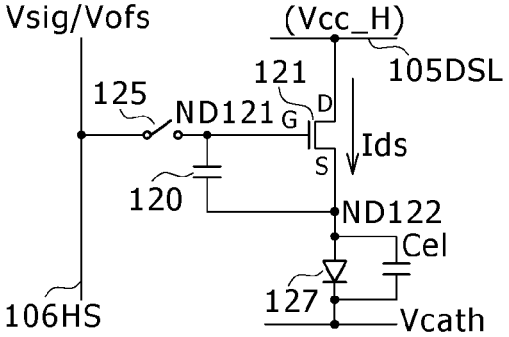

FIG. 8 is a timing chart (in an ideal state) illustrating, as an example of the drive timing concerning the pixel circuit 10, the operation of the pixel circuit 10 of when information on the signal amplitude $\Delta V_{in}$ is written to the hold capacitor 120 line-sequentially. FIGS. 9A to 9G are circuit diagrams each illustrating an equivalent circuit and operation condition in the main ones of the periods described in the timing chart in FIG. 8. In FIG. 8, change in the electric potential of the write scanning line 104WS, change in the electric potential of the power supply line 105DSL, and change in the electric potential of the video signal line 106HS are shown with a common time axis. Changes in the gate electric potential $V_g$ and the source electric potential $V_s$ of the drive transistor 121 are also shown in parallel with these electric potential changes. Basically, the same driving operation is carried out for each of the rows of the write scanning line 104WS and the power supply line 105DSL with a delay of one horizontal scanning period. Hereafter, a description will be given with respect to the pixel circuit 10Z in the display device 1Z of Comparative Example; however, the operation described therein is also applied to the operation of Examples except for those matters specifically noted.

As the signals depicted in FIG. 8, the value of the current that flow through the organic EL element 127 is controlled in accordance with the timing of pulses. In the example of the timing shown in FIG. 8, light quenching and initialization of the node ND122 are carried out by setting the power source drive pulse DSL to the second electric potential $V_{cc_L}$. After that, while the first node initialization voltage $V_{ofs}$ is being supplied to the video signal line 106HS, the sampling transistor 125 is turned ON to initialize the node ND121, and in this state, the power source drive pulse DSL is set to the first electric potential $V_{cc_H}$, thereby carrying out the threshold voltage correction. After that, the sampling transistor 125 is turned OFF and the video signal $V_{sig}$ is applied to the video signal line 106HS. In this state, the sampling transistor 125 is turned ON, thereby carrying out the mobility correction concurrently with writing of the signal. After the signal has been written, the emission is started as the sampling transistor 125 is turned OFF. In such a manner, the driving for the mobility correction, the threshold voltage correction, and the like are controlled by using a phase difference between the pulses.

Next, the operation will be described focusing on the threshold voltage correction and the mobility correction. In the pixel circuit 10Z, with regard to the drive timing, firstly, the sampling transistor 125 is caused to be in a conduction state in accordance with the write drive pulse WS supplied thereto from the write scanning line 104WS, and it samples the video signal $V_{sig}$ supplied thereto from the video signal line 106HS to hold the video signal $V_{sig}$ in the hold capacitor 120. In the following, for the purpose of facilitating explanation and understanding, unless otherwise stated, it is assumed that the write gain is 1 (ideal value) and simple wording and descriptions are used, such as information on the signal amplitude $\Delta V_{in}$ is written, held or sampled in the hold capacitor 120. When the write gain is smaller than 1, the information on the signal amplitude $\Delta V_{in}$ itself is not held in the hold capacitor 120, but gained information corresponding to the magnitude of the signal amplitude $\Delta V_{in}$ is held in the hold capacitor 120.

With regard to the driving timing for the pixel circuit 10, when the information on the signal amplitude $\Delta V_{in}$ of the video signal $V_{sig}$ is written to the hold capacitor 120, from the viewpoint of sequential scanning, the line-sequential driving is performed which simultaneously transmits the video signals for one row to the video signal lines 106HS belonging to the respective columns. In particular, a basic idea of when the threshold voltage correction and the mobility correction are carried out at the drive timing in the pixel circuit 10 is that, firstly, it is supposed that the video signal $V_{sig}$ is differentiated with time between the reference electric potential ($V_{ofs}$) and the signal electric potential ($V_{ofs}+\Delta V_{in}$) during 1 H period of time. Specifically, the period during which the video signal $V_{sig}$ is at the reference electric potential ($V_{ofs}$) and invalid is set as the first-half portion of one horizontal period. On the other hand, the period during which the video signal $V_{sig}$ is held at the signal electric potential ($V_{sig}=V_{ofs}+\Delta V_{in}$) and is valid is set as the second-half portion of one horizontal period of time. When one period of time is divided into a first-half portion and a second-half portion, typically, the period of time is divided in about half thereof. However, such a division manner is not essential to the present disclosure. That is to say, the second-half portion may be made longer than the first-half portion, or contrary to this, the second-half portion may be made shorter than the first-half portion.

The write drive pulse WS, used for the signal writing, is also used for the threshold voltage correction and the mobility correction as well. Thus, the write drive pulse WS is made active twice in one period of time to turn ON the sampling transistor 125. The threshold voltage correction is carried out at the first ON-timing, and the signal voltage writing and the mobility correction are simultaneously carried out at the second ON-timing. After that, the drive transistor 121 receives the current from the power supply line 105DSL held at the first electric potential (high electric potential side) and causes the drive current $I_{ds}$ to flow through the organic EL element 127 in accordance with the signal electric potential (the electric potential corresponding to the electric potential for the valid period of time of the video signal $V_{sig}$) held in the hold capacitor 120. It is noted that instead of making the write drive pulse WS active twice in one period of time H, the electric potential of the video signal line 106HS may be set to the signal electric potential ($=V_{ofs}+V_{in}$) in accordance with which the luminance in the organic EL element 127 is controlled while the sampling transistor 125 is held in the ON state.

For example, in the light emission state of the organic EL element 127, the electric potential of the power supply line 105DSL is held at the first electric potential $V_{cc_H}$, and the sampling transistor 125 is held in the OFF state (refer to period A of FIG. 8). At this time, since the drive transistor 121 is designed so as to operate in a saturated region, the drain current $I_{ds}$ caused to flow through the organic EL element 127 becomes equal to the value represented by Expression (1) which is determined depending on the gate-to-source voltage $V_{gs}$ of the drive transistor 121 (the voltage between the node ND121 and the node ND122). After that, in a time zone in which the electric potential of the power supply line 105DSL is held at the first electric potential $V_{cc_H}$, and the electric potential of the video signal line 106HS is held at the reference electric potential ($V_{ofs}$) of the video signal $V_{sig}$ within the invalid period of time, the vertical drive portion 103 outputs the write drive pulse WS as a control signal in accordance with which the sampling transistor 125 is caused to be conducted. As a result, the voltage corresponding to the threshold voltage $V_{th}$ of the drive transistor 121 is held in the hold capacitor 120 (refer to period D of FIG. 8). This operation realizes the threshold voltage correcting function. This threshold voltage correcting function makes it possible to cancel the influence of the threshold voltages $V_{th}$ of the drive transistors 121 that vary with each pixel circuit 10.

Preferably, the vertical driving portion 103 repetitively carries out the threshold correcting operation for a plurality of horizontal periods preceding the sampling of the signal amplitude $\Delta V_{in}$, thereby reliably holding the voltage corresponding to the threshold voltage $V_{th}$ of the drive transistor 121 in the hold capacitor 120. A sufficiently long write time is ensured by carrying out the threshold voltage correcting operation plural times. As a result, the voltage corresponding to the threshold voltage $V_{th}$ of the drive transistor 121 can be previously and reliably held in the hold capacitor 120.

The voltage corresponding to the threshold voltage $V_{th}$ held in the hold capacitor 120 is used to cancel the dispersion of the threshold voltages $V_{th}$ of the drive transistors 121. Therefore, even when the threshold voltages $V_{th}$ of the drive transistors 121 in the respective pixel circuits 10 are various, since the variation of the threshold voltages $V_{th}$ can be perfectly canceled for each of the pixel circuits 10, the uniformity of the image, that is, the uniformity of the emission luminance over the entire picture of the display is enhanced. In particular, it is possible to prevent the luminance nonuniformity which is apt to appear when the signal electric potential corresponds to the low gradation.

Preferably, prior to the threshold voltage correcting operation, in a time zone for which the electric potential of the power supply line 105DSL is held at the second electric potential $V_{cc_L}$, and the electric potential of the video signal line 106HS is held at the reference electric potential ($V_{ofs}$) of the video signal $V_{sig}$ within the invalid period of time, the vertical drive portion 103 makes the write drive pulse WS active (the H level in this case) to cause the sampling transistor 125 to conduct. After that, the vertical drive portion 103 sets the electric potential of the power supply line 105DSL to the first electric potential $V_{cc_H}$ while the write drive pulse WS is held at the active H level.

As a result, after the source electric potential $V_s$ at the source terminal S of the drive transistor 121 has been set to the second electric potential $V_{cc_L}$ sufficiently lower than the reference electric potential ($V_{ofs}$) (discharge period C=second node initialization period) (refer to period B of FIG. 8), and the gate electric potential $V_g$ at the gate terminal G of the drive transistor 121 has been set to the reference electric potential ($V_{ofs}$) (initialization period D=first node initialization period) (refer to period C of FIG. 8), the threshold voltage correcting operation is started (threshold voltage correction period E). By carrying out such processing for resetting the gate electric potential and the source electric potential (initialization operation), it is possible to reliably carry out the threshold voltage correcting operation following the initialization operation. The combination of the discharge period C and the initialization period D is referred to as "a threshold voltage correction preparation period" as well (=a preprocessing period), during which the gate electric potential $V_g$ and source electric potential $V_s$ of the drive transistor 121 are initialized. Incidentally, in the case illustrated, the initializing operation (the initialization period D) for the node ND121 as the first node is repetitively carried out three times. Thus, the time period from the start of the discharge period C to the end of the final initialization period D is the threshold voltage correction preparation period.

For the threshold voltage correction period E, the electric potential of the power supply line 105DSL transits from the second electric portion $V_{cc_L}$ on the low electric potential side to the first electric portion $V_{cc_H}$ on the high electric potential side, whereby the source electric potential $V_s$ of the drive transistor 121 starts to rise. That is to say, the gate electric potential $V_g$ at the gate terminal G of the drive transistor 121 is held at the reference electric potential ($V_{ofs}$) of the video signal $V_{sig}$. Thus, the drain current $I_{ds}$ is attempting to flow until the source electric potential $V_s$ at the source terminal of the drive transistor 121 rises to cut off the drive transistor 121. When the drive transistor 121 is cut off, the source electric potential $V_s$ at the source terminals of the drive transistor 121 becomes equal to "$V_{ofs}-V_{th}$." For the threshold voltage correction period E, in order that the drain current $I_{ds}$ may be exclusively caused to flow through the hold capacitor 120 side (in a phase of $C_{CS} \ll C_{el}$) and may be prohibited from being caused to flow through the organic EL element 127 side, an electric potential $V_{cath}$ of a grounding wiring cath common to all of the pixels is set in such a way that the organic EL element 127 is cut off.

The equivalent circuit of the organic EL element 127 is represented as a parallel circuit of a diode and the parasitic capacitance $C_{el}$. Therefore, the drain current $I_{ds}$ of the drive transistor 121 is used to charge both of the hold capacitor 120 and the parasitic capacitance $C_{el}$ as long as an electric potential relationship of "$V_{el} \leq V_{cath}+V_{thEL}$" holds, in a word, as long as a leakage current of the organic EL element 127 is considerably smaller than a current caused to flow through the drive transistor 121. As a result, a voltage $V_{el}$ at the anode terminal A of the organic EL element 127, in a word, an electric potential at the node ND122 rises with time. Also, at the time when an electric potential difference between the electric potential at the node ND122 (the source electric potential $V_s$) and the voltage at the node ND121 (the gate electric potential $V_g$) has been just equal to the threshold voltage $V_{th}$, the drive transistor 121 is switched from the ON state over to the OFF state, and thus the drain current $I_{ds}$ is prohibited from being caused to flow. As a result, the threshold voltage correction period E is ended. In a word, after a lapse of a given time, the gate-to-source voltage $V_{gs}$ of the drive transistor 121 takes a value of the threshold voltage $V_{th}$.

Here, although the threshold voltage correcting operation can also be carried out only once, this is not essential to the present disclosure. One horizontal period of time is set as a processing cycle, and the threshold voltage correcting operation may also be repetitively carried out plural times (four times in FIG. 6). For example, actually, the voltage corresponding to the threshold voltage $V_{th}$ is written to the hold capacitor 120 connected between the gate terminal G and the source terminal S of the drive transistor 121. However, the threshold voltage correction period E ranges from the timing at which the write drive pulse WS is set at the active H level to the timing at which the write drive pulse WS is returned back to the inactive L level. Thus, when this period is not sufficiently ensured, the threshold voltage correcting operation is ended in and after this period. For the purpose of solving this problem, it is only necessary to repetitively carry out the threshold voltage correcting operation plural times.

The reason why when the threshold voltage correcting operation is carried out plural times, one horizontal period of time becomes the processing cycle for the threshold voltage correcting operation is because the initializing operation for supplying the reference electric potential ($V_{ofs}$) through the video signal line 106HS in the first-half portion of one horizontal period of time to set the source electric potential $V_s$ to the second electric potential $V_{cc_L}$ is carried out prior to the threshold voltage correcting operation. Necessarily, the threshold voltage correction period E becomes shorter than one horizontal period of time. Therefore, there may be caused the case where the accurate voltage corresponding to the threshold voltage $V_{th}$ is too large to be held in the hold capacitor 120 for the short threshold voltage correcting operation E for one time due to the magnitude relationship between the electrostatic capacitance $C_{CS}$ of the hold capacitor 120, and the second electric potential Vcc_L and other main cases. The reason why the threshold voltage correcting operation is preferably carried out plural times is because it is necessary to cope with this situation. That is to say, preferably, the threshold voltage correcting operation is repetitively carried out for plural horizontal period of time preceding the sampling (signal writing) of the signal amplitude $V_{in}$ to the hold capacitor 120, whereby the voltage corresponding to the threshold voltage $V_{th}$ of the drive transistor 123 is reliably held in the hold capacitor 120.

For example, when the gate-to-source voltage $V_{gs}$ becomes equal to a voltage $V_{x1}$ ($>V_{th}$), in a word, when the source electric potential $V_s$ of the drive transistor 121 is switched from the second electric potential $V_{cc_L}$ on the low electric potential side to "$V_{ofs}-V_{x1}$", a first threshold voltage correction period E_1 is ended (refer to D of FIG. 7). For this reason, at a time point at which the first threshold voltage correction period E_1 has been completed, the voltage Vx1 is written to the hold capacitor 120.

Next, the drive scanning portion 105 switches the write drive pulse WS from the active H level to the inactive L level for the second-half portion of the horizontal period of time. In addition, the horizontal driving portion 106 switches the electric potential of the video signal line 106HS from the reference electric potential ($V_{ofs}$) to the electric potential of the video signal $V_{sig}$ ($=V_{ofs}+V_{in}$) (refer to F of FIG. 7). As a result, the electric potential of the video signal line HS is changed to the electric potential of the video signal $V_{sig}$, while the electric potential of (the write drive pulse WS) the write scanning line 104WS becomes the low L level.

At this time, the sampling transistor 125 is held in the non-conduction (OFF) state, and the drain current Ids corresponding to the voltage $V_{x1}$ held in the hold capacitor 120 in and before that non-conduction state is caused to flow through the organic EL element 127, whereby the source electrode potential $V_s$ slightly rises. When let $V_{a1}$ be the electric potential thus risen, the source electric potential $V_s$ becomes equal to "$V_{ofs}-V_{x1}+V_{a1}$." In addition, the hold capacitor 120 is connected between the gate terminal G and the source terminal S of the drive transistor 121, and the gate electric potential $V_g$ is changed in conjunction with the change in the source electric potential $V_s$ of the drive transistor 121 due to the effect by the hold capacitor 120, whereby the gate electrode potential $V_g$ becomes equal to "$V_{ofs}+V_{a1}$."

For a next second threshold voltage correction period E_2, the pixel circuit 10 is operated in the same manner as that for the first threshold voltage correction period E_1. Specifically, firstly, the gate electric potential $V_g$ at the gate terminal G of the drive transistor 121 is held at the reference electric potential ($V_{ofs}$) of the video signal $V_{sig}$, and the gate electric potential $V_g$ is instantaneously switched from the last "$V_g$=the reference electric potential ($V_{ofs}$)+$V_{a1}$" over to the reference electric potential ($V_{ofs}$). The hold capacitor 120 is connected between the gate terminal G and the source terminal S of the drive transistor 121, and the source electric potential $V_s$ is changed in conjunction with the change in the gate electric potential $V_g$ of the drive transistor 121 due to the effect by the hold capacitor 120. For this reason, the source electric potential $V_s$ is reduced from "$V_{ofs}-V_{x1}+V_{a1}$" by $V_{a1}$, and thus becomes equal to "$V_{ofs}-V_{x1}$." After that, the drain current $I_{ds}$ is attempting to flow until the source electric potential $V_s$ at the source terminal S of the drive transistor 121 rises to cut off the drive transistor 121. However, when the gate-to-source voltage $V_{gs}$ becomes equal to a voltage $V_{x2}$ ($>V_{th}$), in a word, when the source electric potential $V_s$ at the source terminal S of the drive transistor 121 becomes equal to "$V_{ofs}-V_{x2}$", the threshold voltage correction period E_2 is ended. Thus, at a time point at which the first threshold voltage correction period E_1 has been completed, the voltage $V_{x2}$ is written to the hold capacitor 120. Just before a next third threshold voltage correction period E_3, the drain current $I_{ds}$ corresponding to the voltage $V_{x2}$ held in the hold capacitor 120 is caused to flow through the organic EL element 127, whereby the source electric potential $V_s$ becomes equal to "$V_{ofs}-V_{x2}+V_{a2}$.", and the gate electric potential $V_g$ becomes equal to "$V_{ofs}+V_{a2}$."

Likewise, when the gate-to-source voltage $V_{gs}$ becomes equal to a voltage $V_{x3}$ ($>V_{th}$), in a word, when the source electric potential $V_s$ at the source terminal S of the drive transistor 121 becomes equal to "$V_{ofs}-V_{x3}$", the threshold voltage correction period E_3 is ended. Thus, at a time point at which the first threshold voltage correction period E_3 has been completed, the voltage $V_{x2}$ is written to the hold capacitor 120. Just before a next third threshold voltage correction period E_4, the drain current $I_{ds}$ corresponding to the voltage $V_{x3}$ held in the hold capacitor 120 is caused to flow through the organic EL element 127, whereby the source electric potential $V_s$ becomes equal to "$V_{ofs}-V_{x3}+V_{a3}$", and the gate electric potential $V_g$ becomes equal to "$V_{ofs}+V_{a3}$."

Also, for a next fourth threshold voltage correction period E_4, the drain current $I_{ds}$ is caused to flow until the electric potential $V_s$ at the source terminal S of the drive transistor 121 rises to cut off the drive transistor 121. When the drive transistor 121 is cut off, the source electric potential $V_s$ at the source terminal S of the drain transistor 121 becomes equal to "$V_{ofs}-V_{th}$", and the gate-to-source voltage $V_{gs}$ becomes the same state as that of the threshold voltage $V_{th}$. At a time point at which the fourth threshold voltage correction period E_4 has been completed, the threshold voltage $V_{th}$ of the drive transistor 121 is held in the hold capacitor 120.

The pixel circuit 10 includes the mobility correcting function in addition to the threshold voltage correcting function. That is to say, in order that the sampling transistor 125 may be made the conduction state in a time zone for which the electric potential of the video signal line 106HS is held at the signal electric potential "$V_{ofs}+V_{in}$" of the video signal $V_{sig}$ in the valid period of time, the vertical driving portion 103 makes the write drive pulse WS, which is supplied to the write scanning line 104WS, at the active H level only for a period of time shorter than that period of time. For this period of time, in a state in which the signal electric potential ($V_{ofs}+\Delta V_{in}$) is supplied to the control input terminal of the drive transistor 121, both of the parasitic capacitance $C_{el}$ of the organic EL element 127, and the hold capacitor 120 are charged with the electricity through the drive transistor 121 (refer to F of FIG.

8). An active period of time (corresponding not only to a sampling period of time, but to a mobility correction period of time) of the write drive pulse WS is suitably set, whereby when the information on the signal amplitude $\Delta V_{in}$ is held in the hold capacitor 120, at the same time, it is possible to correct the mobility μ of the drive transistor 121. The signal electric potential ($V_{ofs}+\Delta V_{in}$) is actually supplied to the video signal line 106HS by the horizontal driving portion 106, whereby a period of time for which the write drive pulse WS is made at the active H level is set as a period of time for which the information on the signal amplitude $\Delta V_{in}$ is written to the hold capacitor 120 (referred to as "the sampling period of time" as well).

In particular, at the drive timing in the pixel circuit 10, in a time zone for which the electric potential of the power supply line 105DSL is held at the first electric potential $V_{cc_H}$ as the high electric potential side, and the video signal $V_{sig}$ is held in the valid period of time (a period of time of the signal amplitude $\Delta V_{in}$), the write drive pulse WS is made at the active H level. In a word, as a result, the mobility correction time (and the sampling period of time as well) is determined depending on a region in which a time width for which both of the electric potential of the video signal line 102HS is held at the signal electric potential ($V_{ofs}+\Delta V_{in}$) of the video signal $V_{sig}$ in the valid period of time, and the active period of time of the write drive pulse WS overlap each other. In particular, a width of the active period of time of the write drive pulse WS is narrowly determined so as to fall in a time width in which the electric potential of the video signal line 106HS is held at the signal electric potential, which results in that the mobility correction time is determined depending on the write drive pulse WS. Exactly, the mobility correction time (and the sampling period of time as well) becomes a time ranging from a time point at which the write drive pulse WS rises to turn ON the sampling transistor 125 to a time point at which the write drive pulse WS falls to turn OFF the sampling transistor 125. By the way, although in FIG. 8, after completion of the fourth threshold voltage correction period E_4, the electric potential of the write drive pulses WS is temporarily made at the inactive L level, this is not essential to the present disclosure. For example, the electric potential of the video signal $V_{sig}$ may also be switched from the reference electric potential ($V_{ofs}$) over to the signal electric potential ($V_{ofs}+\Delta V_{in}$) in the valid period of time with the electric potential of the write drive pulses WS being held at the active H level.

Specifically, for the sampling period of time, in a state in which the gate electric potential $V_g$ of the drive transistor 121 is held at the signal electric potential ($V_{ofs}+\Delta V_{in}$), the sampling transistor 125 becomes the conduction (ON) state. Therefore, for the write & mobility correction period H of time, in a state in which the gate electric potential $V_g$ of the drive transistor 121 is fixed to the signal electric potential ($V_{ofs}+\Delta V_{in}$), the drive current $I_{ds}$ is caused to flow through the drive transistor 121. The information on the signal amplitude $V_{in}$ is held in the form of being added to the threshold voltage $V_{th}$ of the drive transistor 121. As a result, since the change in the threshold voltage $V_{in}$ of the drive transistor 121 is usually canceled, the threshold voltage correction is carried out. By carrying out the threshold voltage correction, the gate-to-source voltage $V_{gs}$ held in the hold capacitor 120 becomes equal to "$V_{sig}+V_{th}$"="$\Delta V_{in}+V_{th}$." In addition, at the same time, since the mobility correction is carried out for the sampling period of time, the sampling period of time serves as the mobility correction period of time as well (the write & mobility correction period H).

Here, when let $V_{thEL}$ be a threshold voltage of the organic EL element 127, the threshold voltage $V_{thEL}$ is set so as to fulfill an electric potential relationship of "$V_{ofs}-V_{th}<V_{thEL}$." As a result, since the organic EL element 127 is held in a reverse state and thus held in a cut-off state (high impedance state), the organic EL element 127 is prevented from emitting a light, and thus does not offer diode characteristics, but offers simple capacitance characteristics. Therefore, the drain current (the drive current $I_{ds}$) caused to flow through the drive transistor 121 is written to a capacitance "$C=C_{CS}+C_{el}$" which is obtained by adding the electrostatic capacitance $C_{CS}$ of the hold capacitor 120 to the parasitic capacitance (equivalent capacitance) $C_{el}$ of the organic EL element 127. As a result, the drain current of the drive transistor 121 is caused to flow into the parasitic capacitance $C_{el}$ of the organic EL element 127 to start the changing operation. As a result, the source electric potential $V_s$ of the drive transistor 121 rises.

In the timing chart shown in FIG. 8, a rise amount of source electric potential $V_s$ is represented by ΔV. In such a way, at the drive timing in the pixel circuit 10, the sampling of the signal amplitude $\Delta V_{in}$, and the adjustment for ΔV (a negative feedback amount, a mobility correction parameter) for correction of the mobility μ are carried out for the write & mobility correction period H.

The write scanning portion 14 releases the application of the write drive pulse WS to the write scanning line 104WS in a stage of holding the information on the signal amplitude $\Delta V_{in}$ in the hold capacitor 120. That is to say, the electric potential of the write scanning line 104WS is set to the inactive L (low) level. As a result, the sampling transistor 125 is caused to become the non-conduction state, and thus the gate terminal G of the drive transistor 121 is electrically disconnected from the video signal line 106HS (a light emission period I of pulse: refer to G of FIG. 8).

The light emission state of the organic EL element 127 continues up to an (m+m'-1)-th horizontal scanning period of time. With that, the operation of the light emission of the organic EL element 127 composing the (n, m)-th sub-pixel is completed. After that, the operation proceeds to a next frame (or a next field), and the threshold voltage correction preparing operation, the threshold voltage correcting operation, the mobility correcting operation, and the light emitting operation are repetitively carried out again.

For the light emission period I, the gate terminal G of the drive transistor 121 is disconnected from the horizontal signal line 106HS. Since the application of the signal electric potential ($V_{ofs}+\Delta V_{in}$) to the gate terminal G of the drive transistor 121 is released, the gate electric potential $V_g$ of the drive transistor 121 can rise. The hold capacitor 120 is connected between the gate terminal G and the source terminal S of the drive transistor 121, and the bootstrap operation is carried out based on the effect by the hold capacitor 120, and thus the gate-to-source voltage $V_{gs}$ can be maintained constant. At this time, the drive current $I_{ds}$ caused to flow through the drive transistor 121 is also caused to flow through the organic EL element 127, and thus the anode electric potential of the organic EL element 127 rises in accordance with the drive current $I_{ds}$. Let $V_{el}$ be an amount of anode electric potential thus risen. In a short time, since the reverse bias state of the organic EL element 127 is canceled along with the rise of the source electric potential $V_s$, the organic EL element 127 actually starts to emit the light by the inflow of the drive current $I_{ds}$.

[Source of Display Nonuniformity Phenomenon]

As described above, at the driving timings shown in FIG. 8, the mobility correction is processing for supplying the current to the hold capacitor 120 through the drive transistor 121 while the drive current corresponding to the video signal $V_{sig}$ is written to the hold capacitor 120. In the mobility correction, the current is caused to flow through the drive transistor 121 while the video signal $V_{sig}$ is written, thereby causing the source electric potential $V_s$ (the electric potential at the second node) to rise. However, the source electric potential $V_s$ may reach threshold voltage $V_{thEL}$ of (the light emission portion ELP of) the organic EL element 127, so that the organic EL element 127 may be turned ON in some cases. As a result, the rise μ of the source electric potential $V_s$ on which the mobility a of the drive transistor 127 is reflected is impeded, and thus the correcting operation is not normally carried out, which causes the nonuniformity deterioration. For example, when the drive transistor 121 having the excessively large (high) mobility μ is used, the mobility correction is carried out too much. As a result, the crushing of the gate-to-source voltage $V_{gs}$ right before the light emission is caused, thereby generating the remarkable luminance reduction and the uniformity reduction. In order to suppress this evil, for example, it is considered to narrow the mobility correction pulse. Actually, however, the operation is carried out by using the narrow mobility correction pulse, which results in that the setting and management of the pulse width are difficult in terms of the circuit configuration, the delay, and others. For example, since the mobility μ is large in the MOSFET, the mobility correction pulse should be set to about several nano-seconds so as to prevent the mobility correction from being carried out too much to reduce the luminance. Such a narrow pulse is difficult to control. In the light of this point, the problems described above are preferably solved without narrowing the mobility correction pulse (with the current situation being substantially maintained).

[Method of Taking Measures to Cope with Display Nonuniformity Phenomenon]

Figure 10:
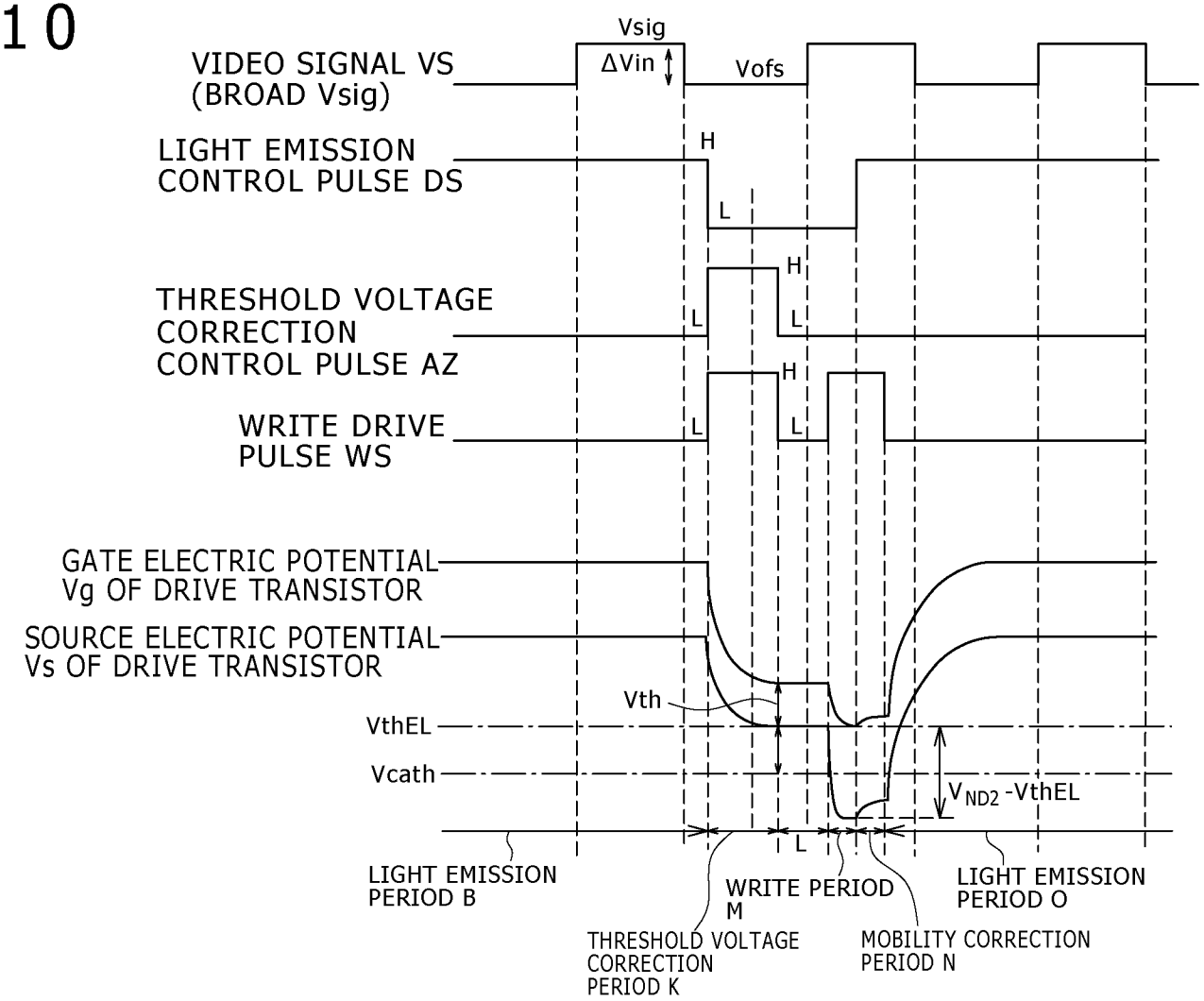
FIG. 10 is a timing chart explaining a method of driving the pixel circuit in the display device of Example 1 of the first embodiment of the present disclosure in which attention is paid to measures to cope with display nonuniformity due to a turn ON phenomenon of an organic EL element for a mobility correction period of time.

FIG. 10 is a timing chart explaining a method of driving the pixel circuit 10A in the display device 1A of Example 1 in which attention is paid to measures taken to cope with the display nonuniformity due to the turn ON phenomenon of the organic EL element 127 for the mobility correction period of time. In this connection, the example shown in FIG. 10 is the case where the initializing operation for the node ND121 as the first node, and the node ND122 as the second node is factually carried out together with the threshold voltage correcting operation, and the threshold voltage correcting operation is carried out once. Although not illustrated, it is also possible to carry out the threshold voltage correcting operation plural times.

The feature of the driving method in this embodiment is that the electric potential at one terminal of the electrooptic element in the phase of start of the mobility correction is controlled so as to become a lower electric potential than that in Comparative Example, in other words, the electrooptic element is previously controlled so as to become a stronger reverse bias state than that in Comparative Example before start of the mobility correction. Specifically, there is adopted a technique with which the electric potential at the second node $ND_2$ is set to the lower electric potential side than that in the normal case in such a way that a difference in electric potential between the opposite terminals of the electrooptic element becomes larger than the threshold voltage $V_{thEL}$ of the electrooptic element in the phase of the signal write, thereby solving the display nonuniformity phenomenon due to the turn ON phenomenon of the electrooptic element during the mobility correction period of time. By adopting such a technique, the electrooptic element can be prevented from being turned ON due to the change in the electric potential at the second node during the mobility correction period of time.

For example, in Example 1, the level of the light emission control pulse DS is set as the inactive L level during the light emission period B of time to turn OFF the light emission control transistor 624, so that the operation enters the quenching period of time. At this time, each of the levels of the write drive pulse WS and the threshold voltage correction control pulse AZ is set as the active H level approximately concurrently with turn OFF of the light emission control transistor 624 to turn OFF both of the sampling transistor 125 and the threshold voltage correction control transistor 626, thereby carrying out the threshold voltage correction. Specifically, for the period of time for which the electric potential of the video signal line 106HS is held at the reference electric potential ($V_{ofs}$), the sampling transistor 125 is turned ON to charge the coupling capacitor 622 with the electricity based on the first node initialization voltage ($V_{ofs}$). Along with this, the light emission control transistor 624 is turned OFF, and the threshold voltage correction control transistor 626 is turned ON (a period K). As a result, an electric potential $V_{ND2}$ at the node ND122 is changed to ($V_{cath}$+$V_{thEL}$), and an electric potential $V_{ND1}$ at the node ND121 is changed to ($V_{ND2}$+$V_{th}$). Since the difference in the electric potential between the first node ND121 and the node ND122 (a voltage developed across the opposite terminals of the hold capacitor 120) becomes equal to the threshold voltage $V_{th}$ of the drive transistor 121, the threshold voltage correction is carried out in such a way. The period K is the threshold voltage correction period of time, and thus the operation for charging the coupling capacitor 622 with the electricity based on the first node initialization voltage ($V_{ofs}$) can be regarded as the initializing operation for both of the first node and the second bode.

After that, each of the levels of the write drive pulse WS and the threshold voltage correction control pulse AZ is set as the inactive L level to turn OFF both of the sampling transistor 125 and the threshold voltage correction control transistor 626 (signal write preparation period L). After that, for the period of time for which the electric potential of the video signal line 106HS is held at the electric potential of the video signal $V_{sig}$ ($V_{ofs}$−$\Delta V_{in}$), the level of the write drive pulse WS is set as the active H level, and the sampling transistor 125 is turned ON again, thereby writing the video signal $V_{sig}$ to the node ND122 (the signal write period M). For the signal write period M, the electric potential of the video signal $V_{sig}$ is the minus electric potential and as a result, the gate-to-source voltage $V_{gs}$ of the drive transistor 121 becomes equal to ($V_{th}$+$V_{sig}$×$G_{in}$). In the phase of the signal writing operation for the signal write period M, how to largely write the information on the signal amplitude $\Delta V_{in}$ to the hold capacitor 120 becomes important. A rate of a size of the information, on the signal amplitude $\Delta V_{in}$, written to the hold capacitor 120 is referred to as a write gain $G_{in}$.

After that, the level of the light emission control pulse DS is set as the active H level with the sampling transistor 125 being held in the ON state, thereby turning ON the light emission control transistor 624. As a result, the current is supplied to the hold capacitor $C_{CS}$ through the drive transistor 121 while the video signal $V_{sig}$ is supplied to one terminal of the hold capacitor 120 through the sampling transistor 125 (in a word, while the drive voltage corresponding to the video signal $V_{sig}$ is written to the hold capacitor 120, thereby executing the mobility correcting processing (a mobility correction period N). That is to say, during the turn ON of the sampling transistor 125, the light emission control transistor 624 is turned ON, whereby the mobility correcting operation is started, and the electric potential at the node ND121 rises with rise of the electric potential at the node ND122. The write scanning portion 104 releases the application of the write drive pulse WS to the write scanning line 104WS in a stage of completion of the mobility correction. Thus, the operation of the write scanning portion 104 proceeds to the processing for a light emission period O.

Here, in the mobility correction, the polarity of write of the video signal $V_{sig}$ to the hold capacitor 120, and the polarity of the current supply through the drive transistor 121 are opposite to each other. For this reason, the change in the electric potential (the electric potential correction value ΔV as the mobility correction parameter) caused by the current supply through the drive transistor 121 is subtracted from the gate-to-source voltage "$V_{gs}=\Delta V_{in}+V_{th}$" held in the hold capacitor 120 through the threshold correction. Although the gate-to-source voltage $V_{gs}$ regulates the luminance in the phase of the light emission, the electric potential correction value ΔV is proportional to the drain current $I_{ds}$ of the drive transistor 121, and the drain current $I_{ds}$ is proportional to the mobility μ. For this reason, as a result, since the electric potential correction value ΔV becomes large as the mobility μ is larger, it is possible to remove the dispersion of the mobilities μ in the pixel circuit 10A.

In such a way, at the drive timings in the pixel circuit 10A of the display device 1A of Example 1, for a mobility correction period N, the electric potential correction value ΔV (the negative feedback amount, the mobility correction parameter) for correction for the mobility μ is adjusted together with the maintaining of the sampling of the signal amplitude $\Delta V_{in}$. The write scanning portion 104 can adjust the time width of the mobility correction period N, whereby it is possible to optimize the negative feedback amount of the drive current $I_{ds}$ for the hold capacitor 120.

The voltage correction value ΔV is expressed by Expression (7):

$$\Delta V \approx I_{ds} \times t / C_{el} \tag{7}$$

As apparent from Expression (7), the voltage correction value ΔV becomes large as the drive current $I_{ds}$ as the drain-to-source current of the drive transistor 121 is larger. Contrary to this, when the drive current $I_{ds}$ of the drive transistor 121 is small, the voltage correction value ΔV becomes small. In such a manner, the voltage correction value ΔV is determined depending on the drive current $I_{ds}$. As the signal amplitude $V_{in}$ is larger, the drive current $I_{ds}$ becomes large and an absolute value of the voltage correction value ΔV also becomes large. Therefore, it is possible to realize the mobility correction corresponding to the emission luminance level. In this case, the mobility correction period N is not necessarily constant, and contrary is preferably adjusted in accordance with the drive current $I_{ds}$ in some cases. For example, it is only necessary that when the drive current $I_{ds}$ is large, a mobility correction period, t, is set short. Contrary to this, it is only necessary that when the drive current $I_{ds}$ becomes small, the write & mobility correction period H of time is set long.

In addition, the electric potential correction value ΔV is expressed by $I_{ds} \times t/C_{el}$. Thus, even when the drive current $I_{ds}$ is dispersed due to the dispersion of the mobilities μ in the pixel circuits 10, the electric potential correction values ΔV are obtained so as to correspond to the respective cases. Therefore, it is possible to correct the dispersion of the mobilities μ in the pixel circuits 10. In a word, when the signal amplitude $V_{in}$ is made constant, the absolute value of the electric potential correction value ΔV becomes large as the mobility μ of the drive transistor 121 is larger. In other words, since the electric potential correction value ΔV becomes large as the mobility μ is larger, it is possible to remove the dispersion of the mobilities μ in the pixel circuits 10.

The light emission state of the organic EL element 127 continues up to an (m+m'−1)-th horizontal scanning period of time. With that, the operation of the light emission of the organic EL element 127 composing the (n, m)-th sub-pixel is completed. After that, the operation is moved to a next frame (or a next field), and the threshold voltage correction preparing operation, the threshold voltage correcting operation, the mobility correcting operation, and the light emitting operation are repetitively carried out again.

Since for the light emission period O of time, the sampling transistor 125 is held in the OFF state, the gate electric potential $V_g$ of the drive transistor 121 can rise. The hold capacitor 120 is connected between the gate terminal G and the source terminal S of the drive transistor 121, and the bootstrap operation is carried out based on the effect by the hold capacitor 120, and thus the gate-to-source voltage $V_{gs}$ can be maintained constant. At this time, the drive current $I_{ds}$ caused to flow through the drive transistor 121 is also caused to flow through the organic EL element 127, and thus the anode electric potential of the organic EL element 127 rises in accordance with the drive current $I_{ds}$. Let $V_{el}$ be an amount of anode electric potential thus risen. In a short time, since the reverse bias state of the organic EL element 127 is canceled along with the rise of the source electric potential $V_s$, the organic EL element 127 actually starts to emit the light by the inflow of the drive current $I_{ds}$. Here, a relationship of the drive current $I_{ds}$ vs. the gate voltage $V_{gs}$ can be expressed in the form of either Expression (8) or (9) by subtracting either "$V_{sig}+V_{th}\times\Delta V$" or "$V_{in}+V_{th}-\Delta V$" into Expression (1) expressing the former transistor characteristics:

$$I_{ds}=k\times\mu\times(V_{sig}-V_{th}-\Delta V)^2 \tag{8}$$

$$I_{ds}=k\times\mu\times(V_{in}-V_{ofs}-\Delta V)^2 \tag{9}$$

It is understood from both of Expressions (8) and (9) that the term of the threshold voltage $V_{th}$ is canceled, and thus the drive current $I_{ds}$ supplied to the organic EL element 127 is independent of the threshold voltage $V_{th}$ of the drive transistor 121. That is to say, when the reference electric potential $V_{ofs}$, for example, 0 V, is set to the drive current $I_{ds}$ caused to flow through the organic EL element 127 is proportional to a square of a value which is obtained by subtracting the value of the electric potential correction value ΔV in the second node $ND_2$ (the source terminal of the drive transistor 121) due to the mobility μ of the drive transistor 121 from the value of the video signal $V_{sig}$ in accordance with which the luminance in the organic EL element 127 is controlled. In other words, the current $I_{ds}$ caused to flow through the organic EL element 127 is independent of both of the threshold voltage $V_{thEL}$ of the organic EL element 127, and the threshold voltage $V_{th}$ of the drive transistor 121. That is to say, an amount of light emission (luminance) of the organic EL element 127 does not suffer both of an influence of the threshold voltage $V_{thEL}$ of the organic EL element 127, and an influence of threshold voltage $V_{th}$ of the drive transistor 121. Also, the luminance of the (n, m)-th organic EL element 127 has a value corresponding to the current $I_{ds}$.

In addition thereto, since the electric potential correction value ΔV becomes large in the drive transistor 121 having the larger mobility μ, the value of the gate-to-source voltage $V_{gs}$ becomes small. Therefore, even when the value of the mobility μ is large in both of Expressions (8) and (9), a value of $(V_{sig}-V_{ofs}-\Delta V)^2$ becomes small. As a result, it is possible to correct the drain current $I_{ds}$. That is to say, if the values of the video signals $V_{sig}$ are identical to one another even in transistors 121 different in mobility μ from one another, the values of the drain currents $I_{ds}$ become approximately equal to one another. As a result, the currents $I_{ds}$ which are caused to flow through the respective organic EL elements 127, and in accordance with which the luminances of the organic EL elements 127 are controlled are uniformized. That is to say, it is possible to correct the dispersion of the luminances in the organic EL elements 127 due to the dispersion of the mobilities a (and the dispersion of k).

In addition, the hold capacitor 120 is connected between the gate terminal G and the source terminal S of the drive transistor 121. Thus, the bootstrap operation is carried out in the first part of the light-emission period of time based on the effect by the hold capacitor 120, and both of the gate electric potential $V_g$ and the source electric potential $V_s$ rise while the gate-to-source voltage "$V_{gs}=V_{in}+V_{th}-\Delta V$" of the drive transistor 121 is maintained constant. The source electric potential $V_s$ of the drive transistor 121 becomes equal to "$-V_{th}+\Delta V+V_{el}$", whereby the gate electric potential $V_g$ becomes equal to "$\Delta V_{in}+V_{el}$." At this time, since gate-to-source voltage $V_{gs}$ of the drive transistor 121 is held constant, the drive transistor 121 causes the constant current (the drive current $I_{ds}$) to flow through the organic EL element 127. As a result, the electric potential (=the electric potential at the node ND122) at the anode terminal A of the organic EL element 127 continuously rises until a voltage with which a current as the drive current $I_{ds}$ in the saturated state is caused to flow through the organic EL element 127.

Here, when the light emission period of time becomes long, the I-V characteristics of the organic EL element 127 are changed accordingly. For this reason, the electric potential at the node ND122 is also changed with a lapse of time. However, even when the anode electric potential of the organic EL element 127 is changed due to such temporal deterioration of the organic EL element 127, the gate-to-source voltage $V_{gs}$ held in the hold capacitor 120 is usually maintained at a constant voltage of "$\Delta V_{in}+V_{th}-\Delta V$." Since the drive transistor 121 is operated as the constant current source, even when the I-V characteristics of the organic EL element 127 suffer the temporal change and the source electric potential $V_s$ at the source terminal S of the drive transistor 121 is changed so as to follow that temporal change, the gate-to-source voltage $V_{gs}$ of the drive transistor 121 is held at the constant voltage ($\approx\Delta V_{in}+V_{th}-\Delta V$) by the hold capacitor 120. Therefore, the current caused to flow through the organic EL element 127 is not changed, and thus the emission luminance of the organic EL element 127 is also held constant. Although since actually, the bootstrap gain is smaller than "1", the gate-to-source voltage $V_{gs}$ becomes smaller than "$\Delta V_{in}+V_{th}-\Delta V$", it is remained that the gate-to-source voltage $V_{gs}$ is held at the gate-to-source voltage $V_{gs}$ corresponding to the bootstrap gain.

As described above, in the pixel circuit 10A in the display device 1 of Example 1, the threshold voltage correcting circuit and the mobility correcting circuit are configured by devising the circuit configuration and the drive timings. Also, the pixel circuit 10A functions as the drive signal fixing circuit for maintaining the drive current constant by correcting the influences by the threshold voltage $V_{th}$ and the mobility μ in order to prevent the influence exerted on the drive current $I_{ds}$ due to the dispersion of the characteristics of the drive transistors 121 (the dispersion of the threshold voltages $V_{th}$ and the carrier mobilities μ in the drive transistors 121 in this case). Since not only the bootstrap operation, but also the threshold voltage correcting operation and the mobility correcting operation are carried out, the gate-to-source voltage $V_{gs}$ maintained by the bootstrap operation is adjusted by both of the voltage corresponding to the threshold voltage $V_{th}$, and the electric potential correction value ΔV for the mobility correction. Therefore, the emission luminance of the organic EL element 127 does not not only suffer the influence of the dispersions of the threshold voltages $V_{th}$ and the carrier mobilities μ in the drive transistors 121, but also suffers the influence of the temporal deterioration of the organic EL element 127. Thus, the image can be displayed with the stable gradation(s) corresponding to the video signal $V_{sig}$ (the signal amplitude $\Delta V_{in}$) inputted and thus it is possible to obtain the image having the high image quality.

In addition, since the pixel circuit 10 can be composed of the source follower circuit using the n-channel drive transistor 121, even when the existing organic EL element having the anode and cathode electrodes is used as it is, the driving for the organic EL element 127 becomes possible. In addition, the pixel circuit 10 can be composed by using the transistors each of which is only of the n-channel type, including the drive transistor, and the sampling transistor and the like of the peripheral portion, and thus the cost saving is realized even in the manufacture of the transistors.

In addition thereto, in the pixel circuit 10A in the display device 1A of Example 1, for the signal write period M, the video signal $V_{sig}$ set at the minus electric potential is written to the node ND122. Therefore, for the following mobility correction period N, the organic EL element 127 can be set in the large reverse bias state. That is to say, for the mobility correction period N, it is possible to fulfill Expression (10) and Expression (11):

$$V_{ND2}=(V_{ofs}-V_{th}+\Delta V)<<(V_{thEL}+V_{cath}) \quad (10)$$

$$V_{ND2}-V_{thEL}<<V_{cath} \quad (11)$$

where $V_{ND2}$ is the electric potential at the node ND122 (the second node ND2). The electric potential difference represented in a left-hand member of Expression (11) can be made larger than that in the case of the pixel circuit 10Z in the display device 1Z of Comparative Example. Therefore, it is possible to prevent the organic EL element 127 from being turned ON during the mobility correction, it is possible to normally carry out the mobility correcting operation, and thus any of the lights is prevented from being emitted.

4-2. Example 2

Figure 11:
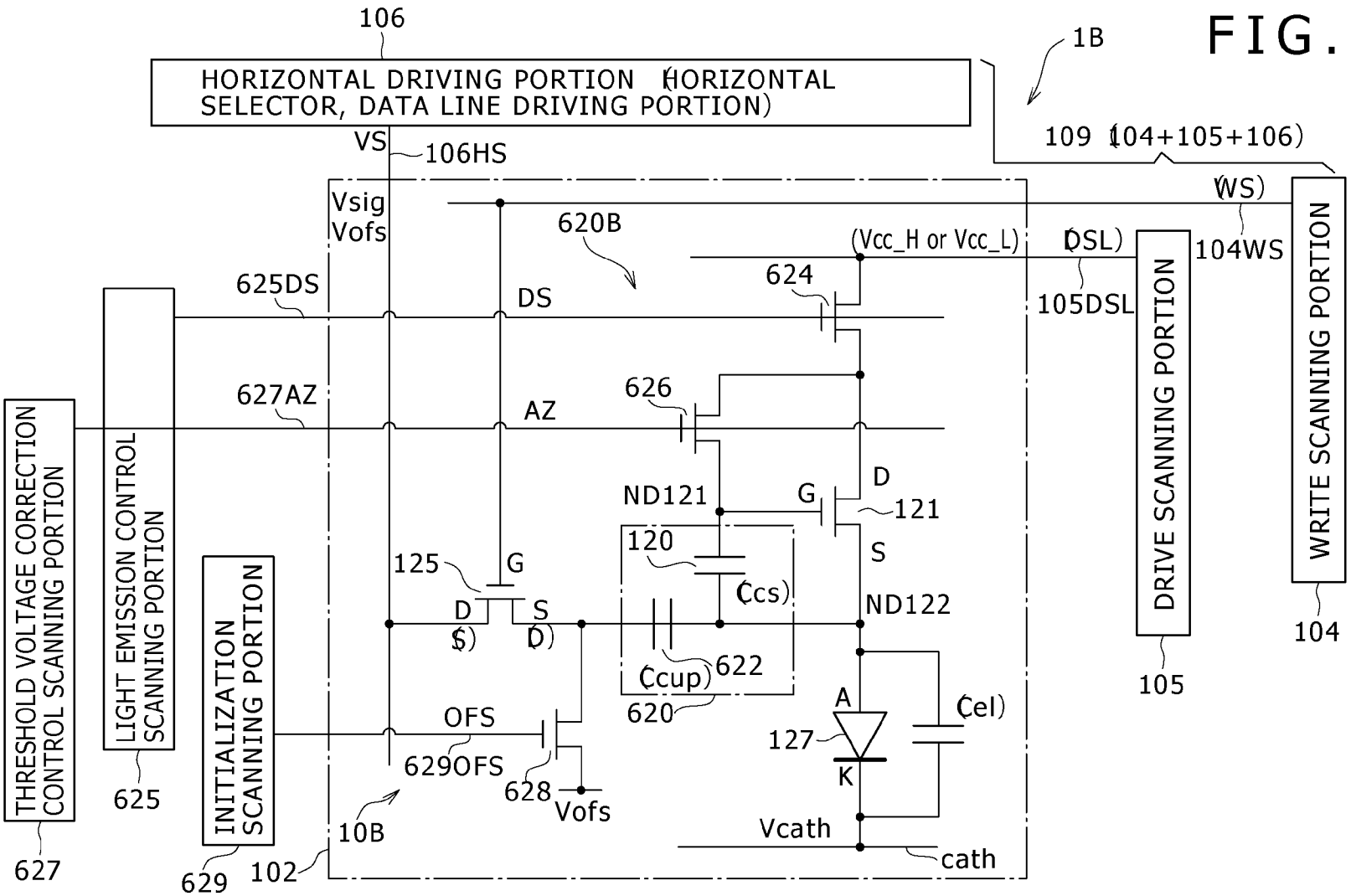
FIG. 11 is a circuit diagram, partly in block, showing a configuration of one form of a pixel circuit in a display device according to Example 2 of the first embodiment of the present disclosure.
Figure 12:
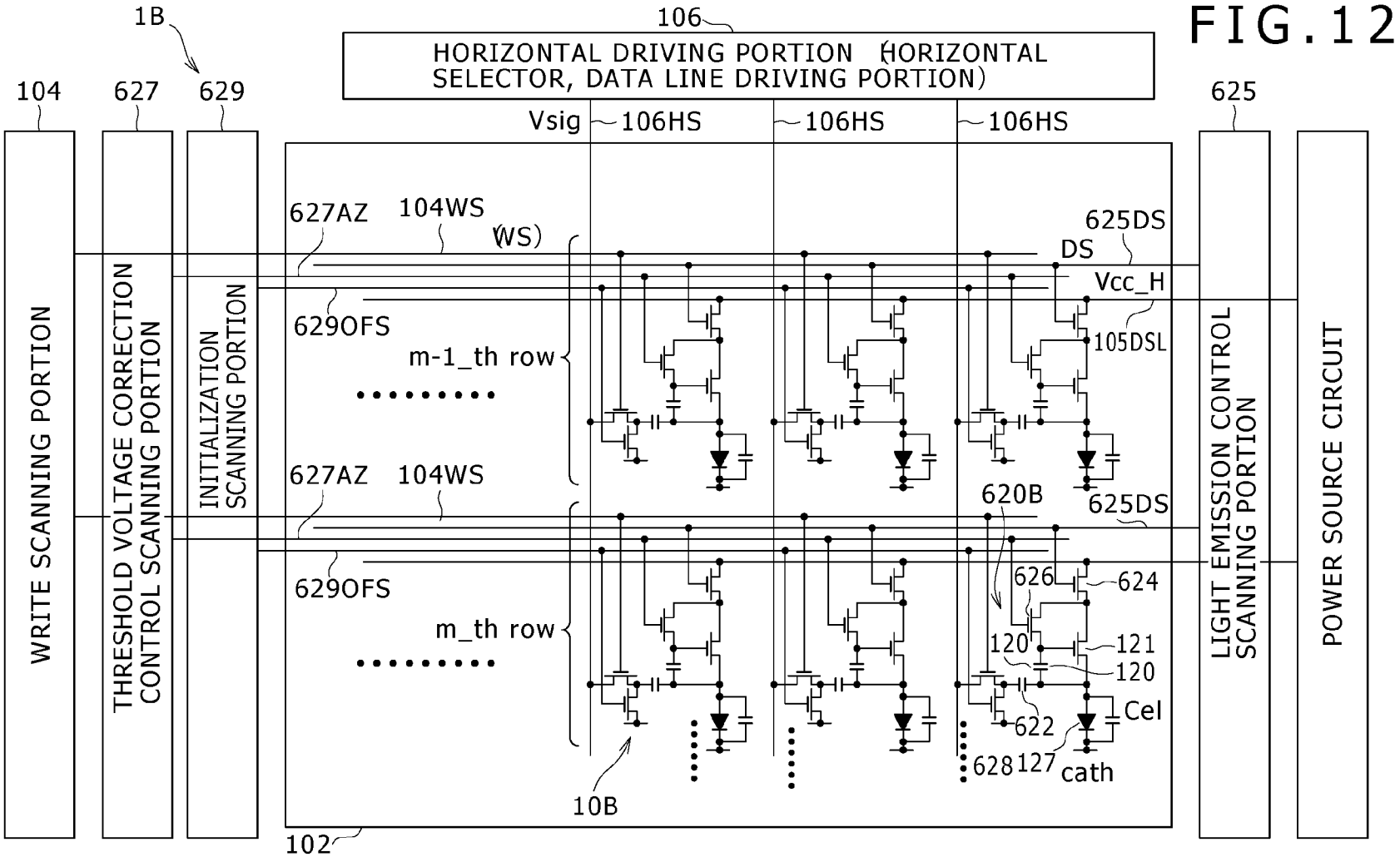
FIG. 12 is a circuit diagram, partly in block, showing a configuration of an entire outline of the display device, including the pixel circuit, of Example 2 of the first embodiment of the present disclosure.

FIGS. 11 and 12 are respectively diagrams showing one form of a pixel circuit 10B and a display device including the pixel circuit 10B of Example 2 of the first embodiment of the present disclosure. The display device including the pixel circuit 10B in the display device 1B of Example 2 in the pixel array portion 102 is referred to as the display device 1B of Example 2. FIG. 11 shows a basic configuration (for one pixel), and FIG. 12 shows a concrete configuration (of the entire display device). Also, FIG. 13 is a timing chart explaining a method of driving the pixel circuit in the display device of Example 2 in which attention is paid to the means taken to cope with the display nonuniformity due to the turn ON phenomenon of the organic EL element 127 during the mobility correction period of time.

As shown in FIGS. 11 and 12, the transistor characteristics correction controlling portion 620B in Example 2 further includes an initialization transistor 628 and an initialization scanning portion 629 based on the configuration of the pixel circuit 10A of the display device 1A of Example 1. Example 2 is different from Example 1 in that only the narrowly-defined video signal $V_{sig}$ is supplied to the video signal line 106HS, and the reference electric potential ($V_{ofs}$) is supplied through the initialization transistor 628. That is to say, the pixel circuit 10B in the display device 1B of Example 2 includes the initialization transistor 628 for applying a first node initialization voltage (the reference electric potential ($V_{ofs}$)). The reference electric potential ($V_{ofs}$) is applied to one of the main electrode terminals of the initialization transistor 628, and the other main electrode terminal of the initialization transistor 628 is connected to a connection point between the main electrode terminal of the sampling transistor 125, and the coupling transistor 622. The display device 1B includes the initialization scanning portion 629 in the outside of the pixel portion 102. A control input terminal (gate terminal) of the initialization transistor 628 is connected to the initialization scanning portion 629 through an initialization control line $\mathbf{629}_{ofs}$, and thus an initialization control pulse OFS set at the active H level is supplied to the control input terminal of the initialization transistor 628 every row.

Figure 13:
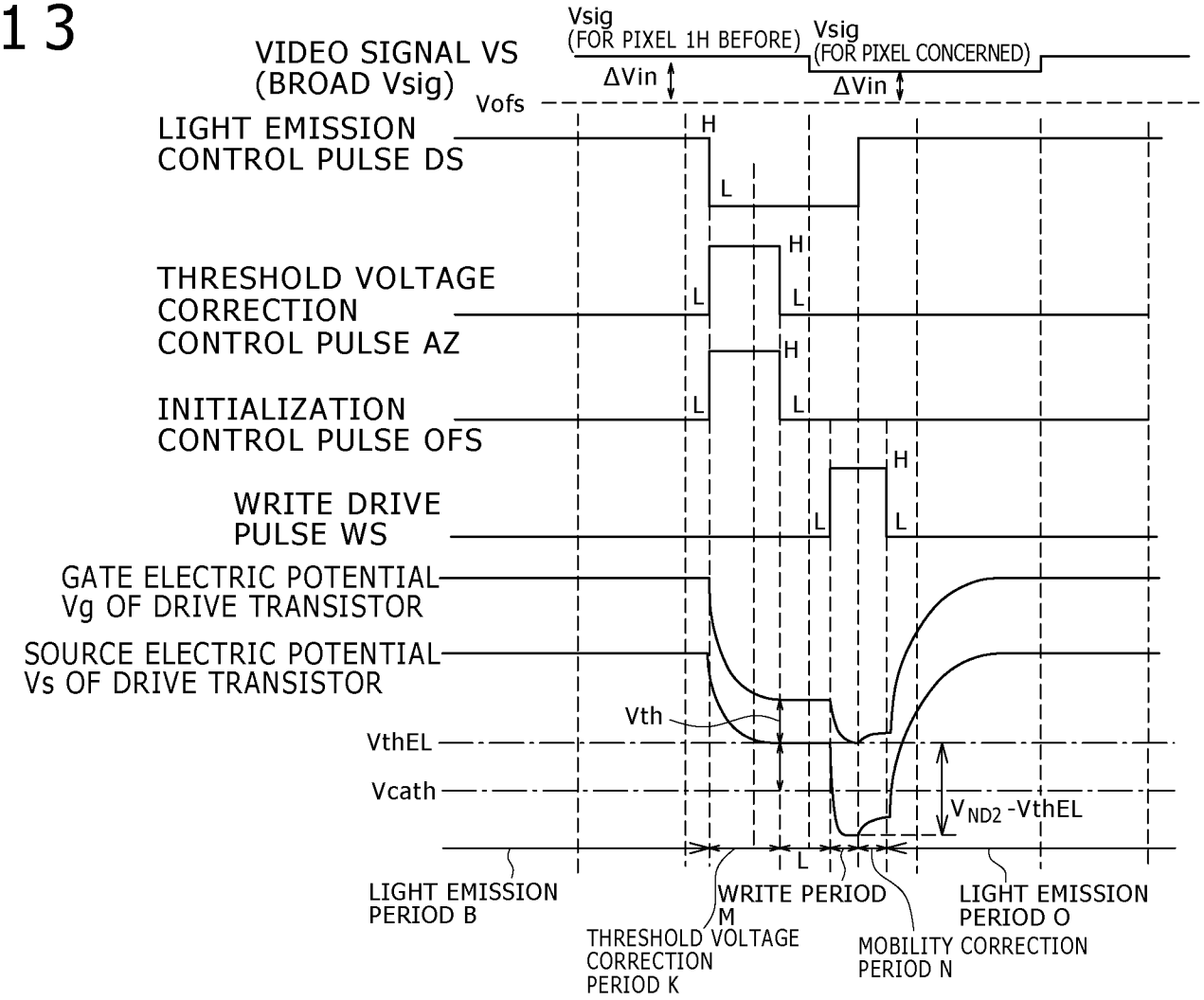
FIG. 13 is a timing chart explaining a method of driving the pixel circuit in the display device of Example 2 of the first embodiment of the present disclosure in which attention is paid to measures to cope with the display nonuniformity due to the turn ON phenomenon of the organic EL element for the mobility correction period of time.

An operation of the pixel circuit 10B in the display device 1B of Example 2 is as shown in FIG. 13. All it takes is that the write drive pulse WS is held at the active H level only for both of the write period M and the mobility correction period N. Example 2 is basically identical to Example 1 except that the first node initialization voltage (the reference electric potential ($V_{ofs}$)) is supplied through the initialization transistor 628 in accordance with the initialization control pulse OFS set at the active H level. Similarly to the case of Example 1, it is possible to prevent the organic EL element 127 from being turned ON during the mobility correction, and it is also possible to normally carry out the mobility correcting operation.

The degree of freedom of setting of the supply timings of the first node initialization voltage (the reference electric potential ($V_{ofs}$)) is higher in Example 2 than in Example 1. As far as a modified change concerned, for example, a configuration may be adopted such that the threshold voltage correction control scanning portion 627 is made to take charge of the function of the initialization scanning portion 629 without providing the initialization scanning portion 629, the control input terminal (gate terminal) of the initialization transistor 628 is connected to the hold voltage correction control line 627AZ, and the threshold voltage correction control pulse AZ set at the active H level is supplied every row. However, although in this modified change, the circuit configuration of the display device 1 become simple, the degree of freedom of setting of the supply timings of the first node initialization voltage is inferior to that in the configuration shown in FIGS. 11 and 12.

5. EXAMPLES OF APPLICATION

FIGS. 14A to 14E are respectively views explaining Examples of Application in each of which the display device according to the first embodiment of the present disclosure is applied to the electronic apparatus according to the fourth embodiment of the present disclosure. Specifically, FIGS. 14A to 14E show respectively cases of electronic apparatuses each loaded with the display device to which the technique for suppressing and solving the display nonuniformity due to the turn ON phenomenon of the organic EL element 127 during the mobility correction period of time described above is applied. The display nonuniformity suppressing processing in the display device of the first embodiment can be applied to a display device including a current drive type display element used in various kinds of electric apparatuses such as a game machine, an electronic book, an electronic dictionary, and a mobile phone.

5-1. Example 1 of Application

Figure 14A:
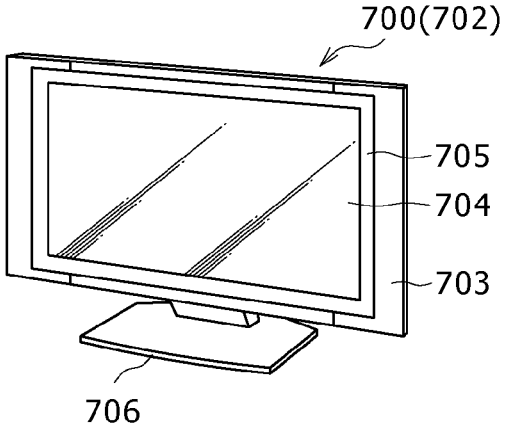
FIG. 14A is a perspective view showing an external appearance of a television receiver as Example 1 of Application to which the display device shown in FIG. 1 of the first embodiment is applied.

For example, FIG. 14A is a perspective view showing an external appearance of a television receiver 702, as Example 1 of Application, in which an electronic apparatus 700 utilizes a display module 704 as an example of a display module 704. The television receiver 702 has a construction in which the display module 704 is disposed on a front surface of a front panel 703 supposed by a base 706. Also, a filter glass 705 is provided on a display surface. In this case, the display module 704 is manufactured by using the display device 1 according to the first embodiment of the present disclosure.

5-2. Example 2 of Application

Figure 14B:
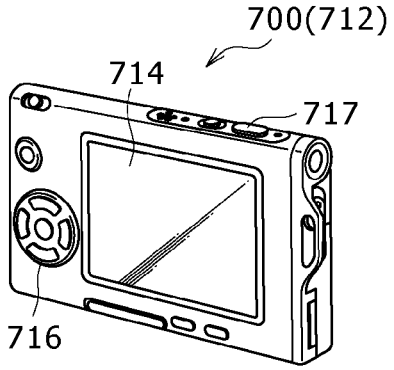
FIG. 14B is a perspective view showing an external appearance of a digital camera as Example 2 of Application, when viewed from a back side, to which the display device shown in FIG. 1 of the first embodiment is applied.

FIG. 14B is a perspective view showing an external appearance of a digital camera, as Example 2 of Application, when the electronic apparatus 700 is the digital camera 712. The digital camera 712 includes a display module 714, a control switch 716, a shutter button 717, and others. In this case, the display module 714 is manufactured by using the display device 1 according to the first embodiment of the present disclosure.

5-3. Example 3 of Application

Figure 14C:
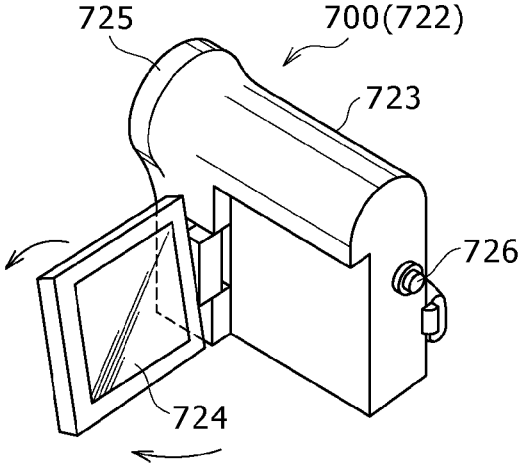
FIG. 14C is a perspective view showing an external appearance of a video camera as Example 3 of Application to which the display device shown in FIG. 1 of the first embodiment is applied.

FIG. 14C is a perspective view showing an external appearance of a video camera, as Example 3 of Application, when the electronic apparatus 700 is the video camera 722. The video camera 722 includes an image capturing lens 725 for capturing an image of a subject in front of a main body 723. In addition, a display module 724, a start/stop switch 726 which is manufactured when an image of a subject is captured, and the like are disposed in the video camera 722. In this case, the display module 724 is manufactured by using the display device 1 according to the first embodiment of the present disclosure.

5-4. Example 4 of Application

Figure 14D:
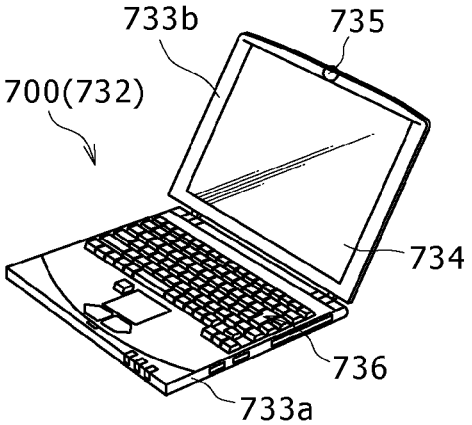
FIG. 14D is a perspective view showing an external appearance of a computer as Example 4 of Application to which the display device shown in FIG. 1 of the first embodiment is applied.

FIG. 14D is a perspective view showing an external appearance of a computer, as Example 4 of Application, when the electronic apparatus 700 is the computer 732. The computer 732 includes a lower side chassis 733*a*, an upper side chassis 733*b*, a display module 734, a Web camera 735, a keyboard 736, and the like. In this case, the display module 734 is manufactured by using the display device 1 according to the first embodiment of the present disclosure.

5-5. Example 5 of Application

Figure 14E:
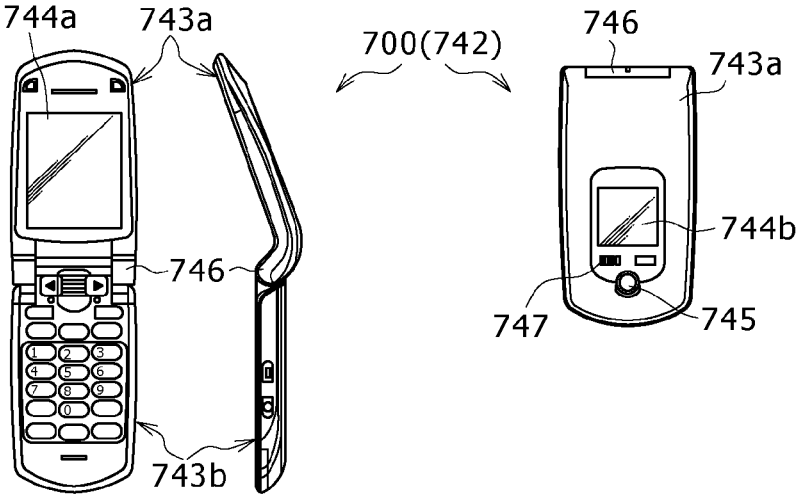
FIG. 14E show a front view of a mobile phone as Example 5 of Application, in an open state, to which the display device shown in FIG. 1 of the first embodiment is applied, a side elevational view thereof in the open state, and a front view thereof in a close state.

FIG. 14E show a front view of a mobile phone as Example 5 of Application, in an open state, in which the electronic apparatus 700 is the mobile phone 742, a side elevational view thereof in the open state, and a front view thereof in a close state. The mobile phone 742 is foldable and includes an upper side chassis 743*a*, a lower side chassis 743*b*, a display module 744*a*, a sub display portion 744*b*, a camera 745, a coupling portion 746 (a hinge portion in this case), a picture light 747, and the like. In this case, the display module portion 744*a* and/or the sub display portion 744*b* is manufactured by using the display device 1 according to the first embodiment of the present disclosure.

As a result, in each of the electronic apparatus 700 in Example 1 of Application to Example 5 of Application, not only the dispersion of the luminances due to the dispersion of the threshold voltages and the mobilities (and the dispersion of k) of the drive transistors 121 can be connected, but also the display nonuniformity due to the turn ON phenomenon of the organic EL element 127 during the mobility correction period of time described above can be suppressed and solved. As a result, it is possible to display the high-quality image.

Although the technique disclosed in this specification has been described so far based on the embodiments, Examples, and the like, the technical scope of the contents described in the appended claims is by no means limited to the scope of the description of the embodiments, Examples, and the like. Various kinds of changes and improvements can be made in the embodiments described above without departing from the subject matter of the technique disclosed in this specification, and the aspects in which such changes and improvements are made are also contained in the technique disclosed in this specification. The embodiments described above do not limit the technique according to the appended claims and all of combinations of the features explained in the embodiments described above are not essential to the means for solving the problems that the technique disclosed in this specification is to solve. Various stages of techniques are contained in the embodiments described above and the various kinds of techniques can be extracted based on suitable combinations in plural constituent requirements shown in the embodiments described above. Even when some constituent requirements are deleted from all of the constituent requirements shown in the embodiments described above, the constitutions obtained by deleting some constituent requirements from all of the constituent requirements can also be extracted as the techniques described in this specification as long as the effect corresponding to the problems that the technique disclosed in this specification is to solve can be offered.

For example, in Example 1 and Example 2, the video signal, and the initialization voltage for correction for the threshold voltage are supplied to the second node through the coupling capacitor. However, this configuration is merely one example in configuration for previously controlling the display device so as to become the reverse bias state before start of the first processing to such a degree that the display portion is not turned ON during the first processing. It is only necessary that the display portion is previously controlled so as to become the reverse bias state before start of the first processing to such a degree that the display portion is not turned ON during the first processing. Thus, it is also possible to adopt a modified change having a configuration in which the video signal having the predetermined polarity, and the initialization voltage for correction for the threshold voltage are supplied to the first node side. It goes without saying that a complementary configuration can be adopted in which for the transistors, the n-channel and the P-channel are replaced with each other, the polarities of the power source and the signals are reversed in accordance with the replacement of the conductivity type, and so forth.

In short, any configuration may also be adopted as long as it is a configuration in which the operation of the pixel circuit is controlled in such a way that the display portion is prevented from being turned ON during the first processing for supplying the current to the hold capacitor through the drive transistor. All it takes is that the configuration is made so as to suppress the display nonuniformity due to that the electrooptic element is turned ON during execution of the processing (corresponding to the mobility correcting processing) for supplying the current to the hold capacitor through the drive transistor while the drive voltage corresponding to the video signal is written to the hold capacitor. As far as this point concerned, it is only necessary that the configuration is made in such a way that the control can be made so as to prevent the electrooptic element from being turned ON at least for the period of time for the processing concerned. Thus, various kinds of configurations can be adopted within the limit. For coping with this, it is not essential to the present disclosure to realize the measures taken to cope with this by devising the control timing of the pixel circuit 10 by the control portion (the light emission control scanning portion 625, the threshold voltage correction control scanning portion 627, and the initialization scanning portion 629 in the above case) provided outside the pixel circuit as with Example 1 and Example 2. Thus, a circuit element for generating a control pulse(s) in accordance with which the various kinds of transistors are controlled may be provided every pixel circuit in order to cope therewith.

For example, it goes without saying that a complementary configuration can be adopted in which for the transistors, the n-channel and the P-channel are replaced with each other, the polarities of the power source and the signals are reversed in accordance with the replacement of the conductivity type, and so forth.

6. CONSTITUTIONS OF THE PRESENT DISCLOSURE

In the light of the description of the embodiments described above, the techniques according to claims disclosed in the scope of the appended claims are merely an example and, for example, the following techniques will be extracted as the constitutions of the present disclosure. Hereinafter, the constitutions of the present disclosure will be listed up as follows.

(1)

A pixel circuit, including: an electrooptic element; a hold capacitor; a write transistor writing a drive voltage corresponding to a video signal supplied to one of main electrode terminals thereof to the hold capacitor; and a drive transistor driving the electrooptic element in accordance with the drive voltage written to the hold capacitor, a control input terminal thereof being connected to one terminal of the hold capacitor at a first node, wherein one of main electrode terminals of the drive transistor, the other terminal of the hold capacitor, and one terminal of the electrooptic element are electrically connected to a second node, and the pixel circuit is adapted such that it can suppress turn ON of the electrooptic element during first processing supplying a current to the hold capacitor through the drive transistor while the drive voltage corresponding to the video signal is written to the hold capacitor through the write transistor.

(2)

The pixel circuit described in paragraph (1), wherein the electrooptic element can be previously controlled before start of the first processing so as to become a reverse bias state to such a degree that the electrooptic element will not turn ON during the first processing.

(3)

The pixel circuit described in paragraph (1) or (2), further including a control portion operative to suppress the electrooptic element being turned ON in conjunction with the first processing supplying the current to the hold capacitor through the drive transistor while the drive voltage corresponding to the video signal is written to the hold capacitor.

(4)

The pixel circuit described in paragraph (3), wherein the control portion includes, between the first node and the other main electrode terminal of the drive transistor, a threshold voltage correction control transistor operative to control second processing correcting a threshold voltage of the drive transistor.

(5)

The pixel circuit described in paragraph (3) or (4), wherein the control portion includes a coupling capacitor between the other main electrode terminal of the write transistor and the second node.

(6)

The pixel circuit described in paragraph (5), wherein, in a phase of second processing correcting a threshold voltage of the drive transistor, an initialization voltage is supplied to the coupling capacitor through the write transistor.

(7)

The pixel circuit described in paragraph (5), wherein the control portion includes an initialization transistor operative to supply an initialization voltage to the coupling capacitor in a phase of second processing correcting a threshold voltage of the drive transistor.

(8)

The pixel circuit described in paragraph (6) or (7), wherein a polarity for an initialization voltage of the video signal is a polarity with which the electrooptic element is controllable to a reverse bias state before start of the first processing.

(9)

The pixel circuit described in any one of paragraphs (3) to (8), wherein the control portion includes a light emission control transistor between the other main electrode terminal of the drive transistor and a power source line.

(10)

The pixel circuit described in any one of paragraphs (1) to (9), further including a pixel portion in which a plurality of the electrooptic elements are arranged, wherein a characteristics controlling portion controls characteristics of the drive transistor.

(11)

The pixel circuit described in paragraph (10), wherein the electrooptic elements are arranged in a two-dimensional matrix in the pixel circuit.

(12)

The pixel circuit described in any one of paragraphs (1) to (11), wherein the electrooptic element is a self-emission type.

(13)

The pixel circuit described in paragraph (12), wherein the electrooptic element includes an organic electroluminescence light emitting portion.

(14)

A display device, including: display elements in an array, the display elements each including an electrooptic element, a hold capacitor, a write transistor operative to write into the hold capacitor a drive voltage corresponding to a video signal supplied to one of main electrode terminals of the write transistor, and a drive transistor operative to drive the electrooptic element in accordance with the drive voltage written to the hold capacitor, a control input terminal of the drive transistor being connected to one terminal of the hold capacitor at a first node, one of main electrode terminals of the drive transistor, the other terminal of the hold capacitor, and one terminal of the electrooptic element are electrically connected to a second node; and a control portion operative to suppress the electrooptic element being turned ON in conjunction with first processing supplying a current to the hold capacitor through the drive transistor while the drive voltage corresponding to the video signal is written to the hold capacitor through the write transistor.

(15)

The display device described in paragraph (14), wherein the control portion includes a threshold voltage correction control transistor between the first node and the other terminal of the main electrode terminals of the drive transistor, the threshold voltage correction control transistor being operative to control second processing correcting a threshold voltage of the drive transistor, and a threshold voltage correction control scanning portion operative to control ON/OFF of the threshold voltage correction control transistor.

(16)

The display device described in paragraph (15), wherein the control portion controls, in a phase of second processing correcting a threshold voltage of the drive transistor, the write transistor whose the one of main electrode terminals is being supplied with an initialization voltage.

(17)

The display device described in paragraph (15), wherein the control portion includes an initialization transistor operative to supply an initialization voltage to a coupling capacitor in a phase of second processing correcting a threshold voltage of the drive transistor, and an initialization scanning portion operative to control ON/OFF of the initialization transistor.

(18)

The display device described in any of paragraphs (14) to (17), wherein the control portion includes a light emission control transistor between the other main electrode terminal of the drive transistor and a power source line, and a light emission control scanning portion operative to control ON/OFF of the light emission control transistor.

(19)

An electronic apparatus, including: a pixel portion including display elements in an array, the display elements each including an electrooptic element, a hold capacitor, a write transistor operative to write into the hold capacitor a drive voltage corresponding to a video signal supplied to one of main electrode terminals of the write transistor, and a drive transistor operative to drive the electrooptic element in accordance with the drive voltage written to the hold capacitor, a control input terminal of the drive transistor being connected to one terminal of the hold capacitor at a first node, one of main electrode terminals of the drive transistor, the other terminal of the hold capacitor, and one terminal of the electrooptic element being electrically connected to a second node; a signal generator operative to generate the video signal supplied to the pixel portion; and a control portion operative to suppress the electrooptic element being turned ON in conjunction with first processing supplying a current to the hold capacitor through the drive transistor while the drive voltage corresponding to the video signal is written to the hold capacitor through the write transistor.

(20)

A method of driving a pixel circuit including a drive transistor driving an electrooptic element, the method including suppressing turn ON of the electrooptic element during processing supplying a current to a hold capacitor through the drive transistor while a drive voltage corresponding to a video signal is written to the hold capacitor.

The present disclosure contains subject matter related to that disclosed in Japanese Priority Patent Application JP 2011-150938 filed in the Japan Patent Office on Jul. 7, 2011, the entire content of which is hereby incorporated by reference.

What is claimed is:

1. A pixel circuit, comprising:

an electrooptic element;

a hold capacitor;

a write transistor configured to write a drive voltage corresponding to a video signal supplied to a first terminal of the write transistor to the hold capacitor;

a drive transistor configured to drive the electrooptic element in accordance with the drive voltage written to the hold capacitor, wherein a control input terminal of the drive transistor is connected to a first terminal of the hold capacitor at a first node, wherein a first terminal of the drive transistor, a second terminal of the hold capacitor, and a first terminal of the electrooptic element are electrically connected to a second node; and a control portion operative to prevent the electrooptic element from turning on during a first processing that supplies a current to the hold capacitor through the drive transistor while the drive voltage corresponding to the video signal is written to the hold capacitor through the write transistor, wherein the control portion includes a coupling capacitor between a second electrode terminal of the write transistor and the second node, wherein a polarity for an initialization voltage of the video signal is a polarity with which the electrooptic element is controllable to a reverse bias state before a start of the first processing, and wherein during a second processing that corrects a threshold voltage of the drive transistor, an initialization voltage is supplied to the coupling capacitor through the write transistor.

2. The pixel circuit according to claim 1, wherein the electrooptic element operates in a reverse bias state prior to the first processing such that the electrooptic element will not turn on during the first processing.

3. The pixel circuit according to claim 1, wherein the control portion includes, between the first node and a second electrode terminal of the drive transistor, a threshold voltage correction control transistor operative to control the second processing that corrects the threshold voltage of the drive transistor.

4. The pixel circuit according to claim 1, wherein the control portion includes an initialization transistor operative to supply an initialization voltage to the coupling capacitor during the second processing that corrects the threshold voltage of the drive transistor.

5. The pixel circuit according to claim 1, wherein the control portion includes a light emission control transistor between the second electrode terminal of the drive transistor and a power source line.

6. The pixel circuit according to claim 1, further comprising a pixel portion in which a plurality of the electrooptic elements are arranged.

7. The pixel circuit according to claim 6, wherein the electrooptic elements are arranged in a two-dimensional matrix in the pixel circuit.

8. The pixel circuit according to claim 1, wherein the electrooptic element is a self-emission type.

9. The pixel circuit according to claim 8, wherein the electrooptic element includes an organic electroluminescence light emitting portion.

10. A display device, comprising:

display elements in an array, each display element including:

an electrooptic element, a hold capacitor, a write transistor configured to write a drive voltage corresponding to a video signal supplied to a first terminal of the write transistor to the hold capacitor, a drive transistor configured to drive the electrooptic element in accordance with the drive voltage written to the hold capacitor, wherein a control input terminal of the drive transistor is connected to a first terminal of the hold capacitor at a first node, wherein a first terminal of the drive transistor, a second terminal of the hold capacitor, and a first terminal of the electrooptic element are electrically connected to a second node, and a control portion operative to prevent the electrooptic element from being turned on during a first processing that supplies a current to the hold capacitor through the drive transistor while the drive voltage corresponding to the video signal is written to the hold capacitor through the write transistor, wherein the control portion includes a coupling capacitor between a second electrode terminal of the write transistor and the second node, wherein a polarity for an initialization voltage of the video signal is a polarity with which the electrooptic element is controllable to a reverse bias state before a start of the first processing, and wherein during a second processing that corrects a threshold voltage of the drive transistor, an initialization voltage is supplied to the coupling capacitor through the write transistor.

11. The display device according to claim 10, wherein the control portion includes:

a threshold voltage correction control transistor between the first node and a second electrode terminal of the drive transistor, the threshold voltage correction control transistor being operative to control the second processing that corrects the threshold voltage of the drive transistor, and a threshold voltage correction control scanning portion operative to control an ON/OFF state of the threshold voltage correction control transistor.

12. The display device according to claim 11, wherein the control portion controls, during the second processing that corrects a threshold voltage of the drive transistor, an initialization voltage to the first electrode terminal of the write transistor.

13. The display device according to claim 11, wherein the control portion includes:

an initialization transistor operative to supply an initialization voltage to the coupling capacitor during the second processing that corrects the threshold voltage of the drive transistor, and an initialization scanning portion operative to control an ON/OFF state of the initialization transistor.

14. The display device according to claim 10, wherein the control portion includes:

a light emission control transistor between the second electrode terminal of the drive transistor and a power source line, and a light emission control scanning portion operative to control an ON/OFF state of the light emission control transistor.

15. An electronic apparatus, comprising:

a pixel portion including display elements in an array, each display element including:

an electrooptic element, a hold capacitor, a write transistor configured to write a drive voltage corresponding to a video signal supplied to a first terminal of the write transistor to the hold capacitor, a drive transistor configured to drive the electrooptic element in accordance with the drive voltage written to the hold capacitor, wherein a control input terminal of the drive transistor is connected to a first terminal of the hold capacitor at a first node, wherein a first terminal of the drive transistor, a second terminal of the hold capacitor, and a first terminal of the electrooptic element are electrically connected to a second node, and a control portion operative to prevent the electrooptic element from turning on during a first processing that supplies a current to the hold capacitor through the drive transistor while the drive voltage corresponding to the video signal is written to the hold capacitor through the write transistor, wherein the control portion includes a coupling capacitor between a second electrode terminal of the write transistor and the second node, wherein a polarity for an initialization voltage of the video signal is a polarity with which the electrooptic element is controllable to a reverse bias state before a start of the first processing, and wherein during a second processing that corrects a threshold voltage of the drive transistor, an initialization voltage is supplied to the coupling capacitor through the write transistor; and a signal generator operative to generate the video signal supplied to the pixel portion.

* * * * *